US009829810B2

(12) United States Patent
Nonaka et al.

(10) Patent No.: US 9,829,810 B2
(45) Date of Patent: Nov. 28, 2017

(54) ELECTROPHOTOGRAPHIC PHOTOSENSITIVE MEMBER, PROCESS CARTRIDGE, ELECTROPHOTOGRAPHIC APPARATUS, AND METHOD FOR PRODUCING ELECTROPHOTOGRAPHIC PHOTOSENSITIVE MEMBER

(71) Applicant: CANON KABUSHIKI KAISHA, Tokyo (JP)

(72) Inventors: Masaki Nonaka, Toride (JP); Ryoichi Tokimitsu, Kashiwa (JP); Shinji Takagi, Yokohama (JP); Koichi Nakata, Tokyo (JP); Haruki Mori, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/342,868

(22) Filed: Nov. 3, 2016

(65) Prior Publication Data

US 2017/0131646 A1 May 11, 2017

(30) Foreign Application Priority Data

Nov. 6, 2015 (JP) ..... 2015-218926

(51) Int. Cl.
*G03G 5/147* (2006.01)
*G03G 5/05* (2006.01)

(52) U.S. Cl.
CPC ..... *G03G 5/0592* (2013.01); *G03G 5/0525* (2013.01)

(58) Field of Classification Search
CPC ... G03G 5/0614; G03G 5/0618; G03G 5/0528
See application file for complete search history.

(56) References Cited

U.S. PATENT DOCUMENTS

2007/0254224 A1* 11/2007 Sugino ..... G03G 5/0525 430/58.35
2012/0301178 A1* 11/2012 Nonaka ..... G03G 5/14791 430/56

FOREIGN PATENT DOCUMENTS

JP 2000-066425 A 3/2000
JP 2009-031721 A 2/2009
(Continued)

OTHER PUBLICATIONS

Yoshinobu Nakao, et al , Establishment of Quantitative Evaluation Method of Image Defects Produced by Copy Machine, Sharp Technical Journal, No. 101, pp. 8-10.

*Primary Examiner* — Peter Vajda
(74) *Attorney, Agent, or Firm* — Canon U.S.A. Inc., IP Division

(57) ABSTRACT

In an electrophotographic photosensitive member including a support and a photosensitive layer formed on the support, a surface layer of the electrophotographic photosensitive member contains a cured product obtained by copolymerizing at least one compound (i) selected from the group consisting of a triphenylamine compound having a hydroxymethyl group and a benzidine compound having a hydroxymethyl group, and at least one compound (ii) selected from the group consisting of a compound represented by the following formula (1), a compound represented by the following formula (2), a compound represented by the following formula (3), and a compound represented by the following formula (4):
(Continued)

(1)

(2)

(3)

-continued (4)

18 Claims, 2 Drawing Sheets

(56) References Cited

FOREIGN PATENT DOCUMENTS

| | | | |
|---|---|---|---|
| JP | 2011-133853 | A | 7/2011 |
| JP | 2013-008013 | A | 1/2013 |
| JP | 2013-008014 | A | 1/2013 |

* cited by examiner

ELECTROPHOTOGRAPHIC PHOTOSENSITIVE MEMBER, PROCESS CARTRIDGE, ELECTROPHOTOGRAPHIC APPARATUS, AND METHOD FOR PRODUCING ELECTROPHOTOGRAPHIC PHOTOSENSITIVE MEMBER

BACKGROUND OF THE INVENTION

Field of the Invention

Aspects of the present disclosure generally relate to an electrophotographic photosensitive member, a process cartridge, an electrophotographic apparatus, and a method for producing the electrophotographic photosensitive member.

Description of the Related Art

In recent years, there have been requirements for electrophotographic apparatuses to be capable of outputting numerous high-quality images (printed products). Therefore, electrophotographic photosensitive members, which can be repeatedly used in electrophotographic apparatuses, are required to have a long lifetime.

To prolong the lifetime of an electrophotographic photosensitive member, it is important to enhance the mechanical strength of the electrophotographic photosensitive member.

Japanese Patent Application Laid-Open No. 2000-066425 discusses a technique that causes a cured product obtained by chain polymerization reaction of a charge transporting compound having a chain-polymerizable functional group to be contained in a surface layer of an electrophotographic photosensitive member to improve the mechanical strength of the electrophotographic photosensitive member, thus attaining the prolongation of the lifetime of the electrophotographic photosensitive member.

Japanese Patent Application Laid-Open No, 2009-031721 discusses a technique that causes a cured product obtained step-growth polymerization reaction of a guanamine compound to be contained in a surface layer of an electrophotographic photosensitive member to improve the mechanical strength of the electrophotographic photosensitive member, thus attaining the prolongation of the lifetime of the electrophotographic photosensitive member.

Japanese Patent Application Laid-Open No. 2013-008013 discusses a technique that causes a cured product obtained by chain polymerization reaction of a urea compound having a chain-polymerizable functional group to be contained in a surface layer of an electrophotographic photosensitive member to prevent the occurrence of image smearing (image deletion).

Japanese Patent Application Laid-Open No, 2013-008014 and Japanese Patent Application Laid-Open No. 2011-133853 discusses a technique that causes a specific urea compound to be contained in surface layer of an electrophotographic photosensitive member.

However, in the electrophotographic photosensitive members described in Japanese Patent Application Laid-Open No. 2000-066425 and Japanese Patent. Application Laid-Open No. 2013-008013, a chain polymerization reaction tends to be inhibited by oxygen in the air, there is such an issue in production that the cured product needs to be formed in a special environment in which the concentration of oxygen is low.

In the electrophotographic photosensitive member described in Japanese Patent Application Laid-Open. No. 2009-031721, an improvement in the mechanical strength of the electrophotographic photosensitive member with a cured product obtained by using a guanamine compound is attempted by the use of a step-growth polymerization reaction in which the above-mentioned issue in production is resolved.

However, since the surface of the electrophotographic photosensitive member becomes not readily refreshable due to an improvement in mechanical strength, image smearing tends to occur due to the repetitive use in a high temperature and high humidity environment, so that it is difficult to attain both an adequate mechanical strength and the prevention of image smearing at the same time.

Furthermore, the need for long lifetime the market is very high, and there is room for further improvement even in the electrophotographic photosensitive members described in Japanese Patent Application Laid-Open No. 2013-008014 and Japanese Patent Application Laid-Open No, 2011-133853.

SUMMARY OF THE INVENTION

An aspect of the present disclosure is directed to providing an electrophotographic photosensitive member having an adequate mechanical strength, an adequate effect for prevention of image smearing, and adequate electrical characteristics.

Another aspect of the present disclosure is directed to providing a process cartridge and an electrophotographic apparatus each of which includes the above-mentioned electrophotographic photosensitive member.

A further aspect of the present disclosure is directed to providing a method for producing the above-mentioned electrophotographic photosensitive member.

According to an aspect of the present disclosure, an electrophotographic photosensitive member includes a support and a photosensitive layer formed on the support, wherein a surface layer of the electrophotographic photosensitive member contains a cured product obtained by copolymerizing:

at least one compound (i) selected from the group consisting of a triphenylamine compound having a hydroxymethyl group and a benzidine compound having a hydroxymethyl group; and at least one compound (ii) selected from the group consisting of a compound represented by the following formula (1), a compound represented by the following formula (2), a compound represented by the following formula (3), and a compound represented by the following formula (4):

(1)

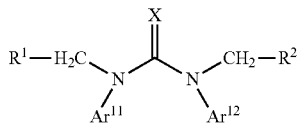

(2)

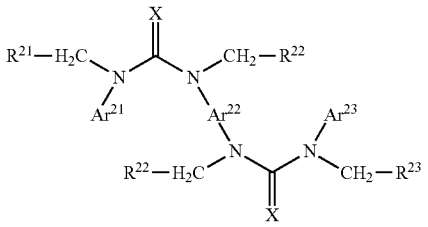

-continued (3)

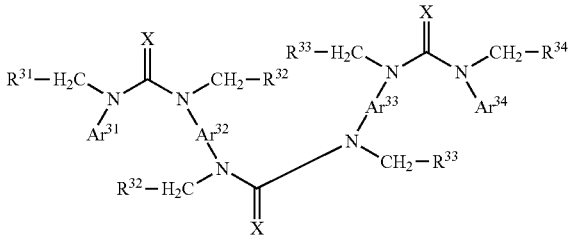

(4)

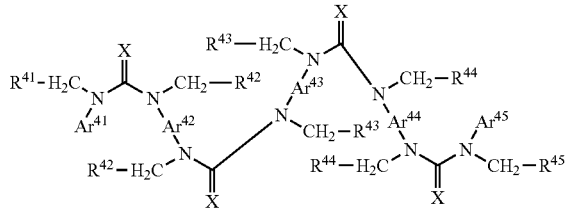

where, in the formulae (1) to (4), X represents an oxygen atom or a sulfur atom, $R^1$, $R^2$, $R^{21}$, $R^{22}$, $R^{23}$, $R^{31}$, $R^{32}$, $R^{33}$, $R^{34}$, $R^{41}$, $R^{42}$, $R^{43}$, $R^{44}$, and $R^{45}$ each independently represent a hydrogen atom or a monovalent group derived by removing one hydrogen atom from a saturated aliphatic hydrocarbon with a carbon number of 4 or less in a straight chain, $Ar^{11}$, $Ar^{12}$, $Ar^{21}$, $Ar^{23}$, $Ar^{31}$, $Ar^{34}$, $Ar^{41}$, and $Ar^{45}$ each independently represent a substituted or unsubstituted aryl group, $Ar^{22}$, $Ar^{32}$, $Ar^{33}$, $Ar^{42}$, $Ar^{43}$, and $Ar^{44}$ each independently represent a substituted or unsubstituted arylene group, a substituent of the aryl group or the arylene group is a group selected from the group consisting of a methyl group and a hydroxymethyl group, at least one of $Ar^{11}$ and $Ar^{12}$ is an aryl group having a hydroxymethyl group as a substituent, at least one of $Ar^{21}$ to $Ar^{23}$ is an aryl group or arylene group having a hydroxymethyl group as a substituent, at least one of $Ar^{31}$ to $Ar^{34}$ is an aryl group or arylene group having a hydroxymethyl group as a substituent, and at least one of $Ar^{41}$ to $Ar^{45}$ is an aryl group or arylene group having a hydroxymethyl group as a substituent.

According to another aspect of the present disclosure, a process cartridge is configured to integrally support the above-mentioned electrophotographic photosensitive member and at least one unit selected from the group consisting of a charging unit, a developing unit, a transfer unit, and a cleaning unit, and is configured to be detachably attachable to a main body of an electrophotographic apparatus.

According to yet another aspect of the present disclosure, an electrophotographic apparatus includes the above-mentioned electrophotographic photosensitive member, a charging unit, an exposure unit, a developing unit, and a transfer unit.

According to yet another aspect of the present disclosure, a method for producing an electrophotographic photosensitive member including a support and a photosensitive layer formed on the support includes:

forming a coating film using a surface layer coating solution containing at least one compound (i) selected from the group consisting of a triphenylamine compound having a hydroxymethyl group and a benzidine compound having a hydroxymethyl group; and at least one compound (ii) selected from the group consisting of a compound represented by the above formula (1), a compound represented by the above formula (2), a compound represented by the above formula (3), and a compound represented by the above formula (4); and forming a surface layer of the electrophotographic photosensitive member by copolymerizing the at least one compound (i) and the at least one compound (ii) and curing the coating film.

Further features of the present disclosure will become apparent from the following description of exemplary embodiments with reference to the attached drawings.

Figure 1A:
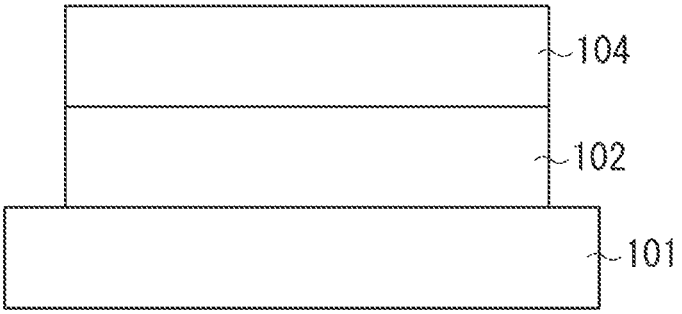
FIG. 1A illustrates an example of a layered structure of an electrophotographic photosensitive member according to an exemplary embodiment.

DESCRIPTION OF THE EMBODIMENTS (Electrophotographic Photosensitive Member)

An electrophotographic photosensitive member according to an exemplary embodiment includes a support and a photosensitive layer formed on the support, wherein a surface layer of the electrophotographic photosensitive member contains a cured product obtained by copolymerizing:

at least one compound (i) selected from the group consisting of a triphenylamine compound having a hydroxymethyl group and a benzidine compound having a hydroxymethyl group; and at least one compound (ii) selected from the group consisting of a compound represented by the following formula (1), a compound represented by the following formula (2), a compound represented by the following formula (3), and a compound represented by the following formula (4):

(1)

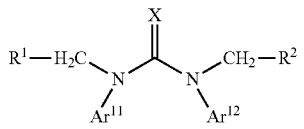

(2)

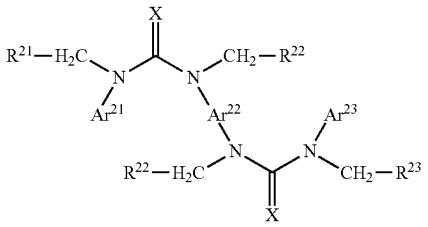

-continued (3)

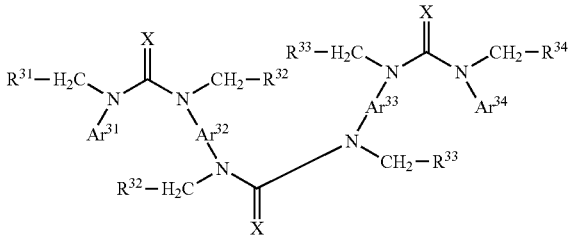

(4)

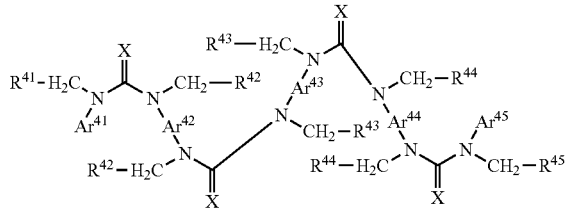

In the formulae (1) to (4), X represents an oxygen atom or a sulfur atom.

$R^1$, $R^2$, $R^{21}$, $R^{22}$, $R^{23}$, $R^{31}$, $R^{32}$, $R^{33}$, $R^{34}$, $R^{41}$, $R^{42}$, $R^{43}$, $R^{44}$, and $R^{45}$ each independently represent a hydrogen atom or a monovalent group derived by removing one hydrogen atom from a saturated aliphatic hydrocarbon with a carbon number of 4 or less in a straight chain.

$Ar^{11}$, $Ar^{12}$, $Ar^{21}$, $Ar^{23}$, $Ar^{31}$, $Ar^{34}$, $Ar^{41}$, and $Ar^{45}$ each independently represent a substituted or unsubstituted aryl group.

$Ar^{22}$, $Ar^{32}$, $Ar^{33}$, $Ar^{42}$, $Ar^{43}$, and $Ar^{44}$ each independently represent a substituted or unsubstituted arylene group.

A substituent of the aryl group or the arylene group is a group selected from the group consisting of a methyl group and a hydroxymethyl group.

At least one of $Ar^{11}$and $Ar^{12}$ is an aryl group having a hydroxymethyl group as a substituent.

At least one of $Ar^{21}$ to $Ar^{23}$ is an aryl group or arylene group having a hydroxymethyl group as a substituent.

At least one of $Ar^{31}$ to $Ar^{34}$ is an aryl group or arylene group having a hydroxymethyl group as a substituent.

At least one of $Ar^{41}$ to $Ar^{45}$ is an aryl group or arylene group having a hydroxymethyl group as a substituent.

$R^1$, $R^2$, $R^{21}$, $R^{22}$, $R^{23}$, $R^{31}$, $R^{32}$, $R^{33}$, $R^{34}$, $R^{41}$, $R^{42}$, $R^{43}$, $R^{44}$, and $R^{45}$ have, for example, the following structures (a) to (k), but the present exemplary embodiment is not limited to those.

(a) $H—$ (b) $CH_3—$ (c) $CH_3CH_2—$ (d) $CH_3CH(CH_3)—$ (e) $CH_3CH_2CH_2—$ (f) $CH_3CH(CH_3)CH_2—$

-continued (g) $CH_3CH_2CH(CH_3)—$ (h) $CH_3CH_2CH(CH_2CH_3)—$ (i) $CH_3CH_2CH_2CH_2—$ (j) $CH_3CH(CH_3)CH_2CH_2—$ (k) $CH_3CH_2CH(CH_2CH_3)CH_2—$ $Ar^{11}$, $Ar^{12}$, $Ar^{21}$, $Ar^{23}$, $Ar^{31}Ar^{34}$, $Ar^{41}$, and $Ar^{45}$ each include, for example, a monovalent group derived by removing one hydrogen atom from benzene, naphthalene, fluorene, phenanthrene, anthracene, pyrene, biphenyl, terphenyl, or stilbene.

$Ar^{22}$, $Ar^{32}$, $Ar^{33}$, $Ar^{42}$, $Ar^{43}$, and $Ar^{44}$ each include, for example, a bivalent group derived by removing two hydrogen atoms from benzene, naphthalene, fluorene, phenanthrene, anthracene, pyrene, biphenyl, terphenyl, or stilbene.

A hydroxymethyl group included in each of $Ar^{11}$, $Ar^{12}$, $Ar^{21}$ to $Ar^{23}$, $Ar^{31}$ to $Ar^{34}$, and $Ar^{41}$ to $Ar^{45}$ can be in a state of being protected by an appropriate protective group. In that case, in causing a step-growth polymerization reaction for obtaining a cured product, the group needs to separate from the protective group and return to a hydroxymethyl group before the step-growth polymerization reaction. The states of the hydroxymethyl group being protected by a protective group include, for example, the following structures (a') to (k'), but the present exemplary embodiment not limited to those.

(a') $—CH_2O—CH_3$ (b') $—CH_2O—CH_2CH_3$ (c') $—CH_2O—CH_2CH_2CH_3$ (d') $—CH_2O—CH_2CH_2CH_2CH_3$ (e') $—CH_2O—CH_2OCH_3$ (f') $—CH_2O—CH_2CH_2OCH_2CH_3$ (g')

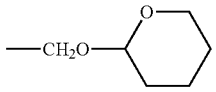

(h')

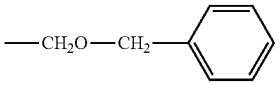

(i')

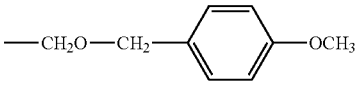

(j') $—CH_2O—C(=O)—CH_3$

-continued (k')

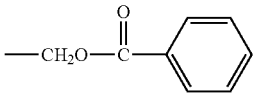

As mentioned in the foregoing, an electrophotographic photosensitive member (hereinafter also referred to simply as a "photosensitive member") according to the present exemplary embodiment has an adequate mechanical strength and adequate electrical characteristics and is also capable of preventing image smearing. The inventors presume the reason of capability of prevention of image smearing as follows.

A technical literature points out that discharge products (for example, ozone and nitrogen oxide) deposited on the surface of a photosensitive member react with moisture in a high-humidity environment to produce nitric acid and causes image smearing (Sharp Technical Journal No. 101, August, 2010, *"Fukushakigazofuryo no teiryotekina hyokahoho no kakuritsu* (*Establishment of Quantitative Evaluation Method of Image Defects in Copying Machine*)").

Nitric acid deposited on the surface layer of the photosensitive member acts on a charge transporting compound contained in the photosensitive member to produce an ion pair having a relatively iong life on the surface of the photosensitive member, which changes the surface resistivity of the surface layer. This can result in an insufficient light area potential at a boundary between an image-forming portion and a non-image-forming portion and consequently a low image density of the image-forming portion (a blurred image or a missing image), which is called image smearing (image deletion).

Then, the compound represented by each of the formulae (1) to (4) according to the present exemplary embodiment (hereinafter also referred to as the "compound of the present exemplary embodiment") has such a configuration that an aryl group or arylene group is adjacent to its urea moiety or thiourea moiety and an alkyl group is adjacent to nitrogen atoms. Because of such a structure, the nitrogen atoms of the compound of the present exemplary embodiment are likely to preferentially form an ion pair having a relatively short life with nitric acid derived from discharge products as compared with nitrogen atoms included in the charge transporting compound. This can reduce variations in the surface resistivity of the surface layer and provide a sufficient light area potential at a boundary between an image-forming portion and a non-image-forming portion. This will prevent a decrease in the image density of the image-forming portion and prevent image smearing.

If the alkyl group adjacent to the nitrogen atoms of the compound of the present exemplary embodiment has such a structure as to branch from a carbon atom directly adjacent to the nitrogen atoms, since the nitrogen atoms serve as a steric hindrance when forming an ion pair with the nitric acid, an effect of preventing image smearing may be difficult to obtain. More specifically, the group directly adjacent to the nitrogen atoms needs to be a methyl group or a methylene group.

Furthermore, if the alkyl group adjacent to the nitrogen atoms of the compound of the present exemplary embodiment has a length with a carbon number of 6 or more in a straight chain, since a hydroxymethyl group included in the same molecule serves as a steric hindrance when performing a polymerization reaction, a cured product having a high mechanical strength may be difficult to obtain. More specifically, in the formulae (1) to (4), $R^1$, $R^2$, $R^{21}$, $R^{22}$, $R^{23}$, $R^{31}$, $R^{32}$, $R^{33}$, $R^{34}$, $R^{41}$, $R^{42}$, $R^{43}$, $R^{44}$, and $R^{45}$ each need to be independently hydrogen atom or a monovalent group derived by removing one hydrogen atom from a saturated aliphatic hydrocarbon with a carbon number of 4 or less in a straight chain. It is desirable that. $R^1$, $R^2$, $R^{21}$, $R^{22}$, $R^{23}$, $R^{31}$, $R^{32}$, $R^{33}$, $R^{34}$, $R^{41}$, $R^{42}$, $R^{43}$, $R^{44}$, and $R^{45}$ each be independently a methyl group or an ethyl group.

Moreover, the urea moiety or thiourea moiety of the compound of the present exemplary embodiment tends to become a trap site that hinders charge transfer. If an alkyl group adjacent to the nitrogen atoms is large to some extent, such an influence can be reduced, so that adequate electrical characteristics can be obtained. More specifically, in the formulae (1) to (4), $R^1$, $R^2$, $R^{21}$, $R^{22}$, $R^{23}$, $R^{31}$, $R^{32}$, $R^{33}$, $R^{34}$, $R^{41}$, $R^{42}$, $R^{43}$, $R^{44}$, and $R^{45}$ each need to be independently a hydrogen atom or a monovalent group derived by removing one hydrogen atom from a saturated aliphatic hydrocarbon with a carbon number of 4 or less in a straight chain.

While the following are specific examples (A-1) to (A-16), (B-1) to (B-13), (C-1), and (D-1) of the compounds represented by the formulae (1) to (4) in the present exemplary embodiment, the present invention is not limited to these examples.

(A-1)

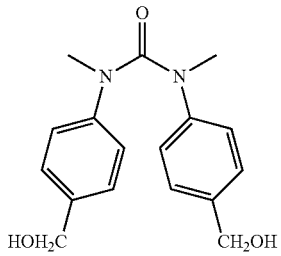

(A-2)

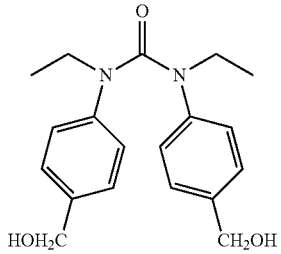

(A-3)

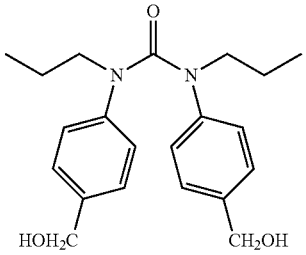

-continued
(A-4)
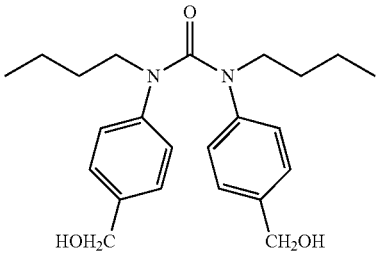
(A-5)
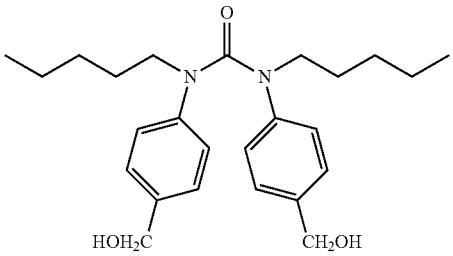
(A-6)
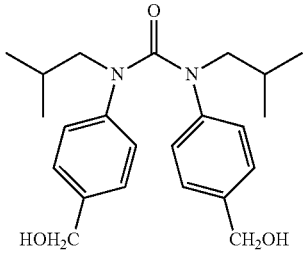
(A-7)
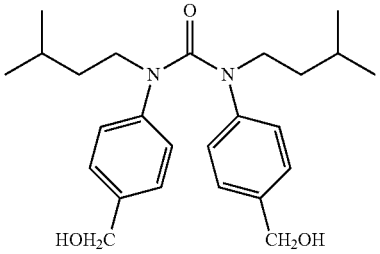
(A-8)
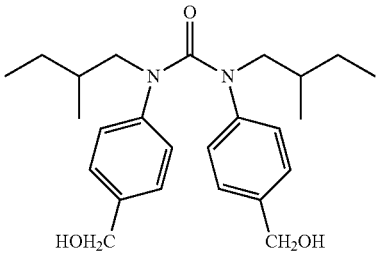
(A-9)
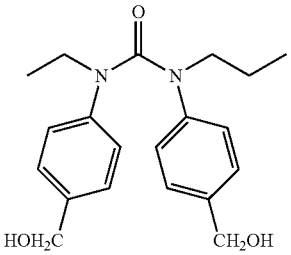
-continued
(A-10)
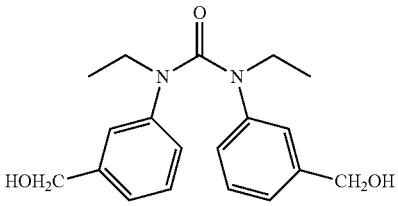
(A-11)
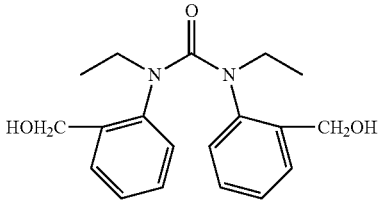
(A-12)
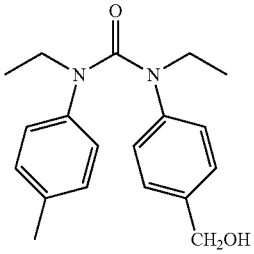
(A-13)
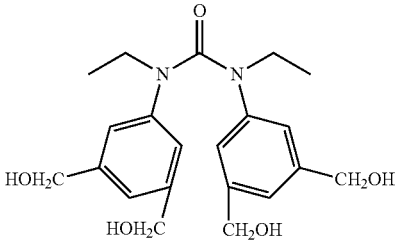
(A-14)
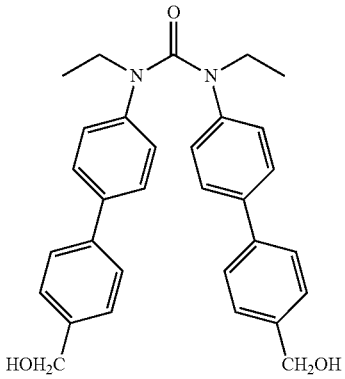
(A-15)
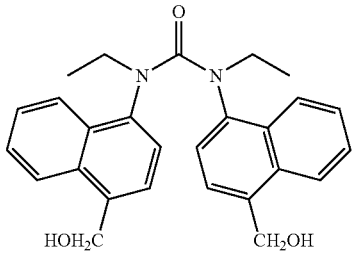

-continued
(A-16)
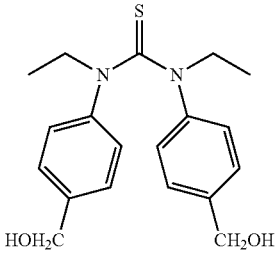
(B-1)
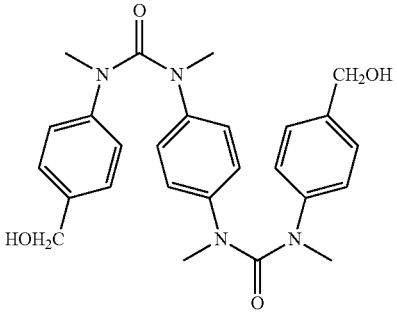
(B-2)
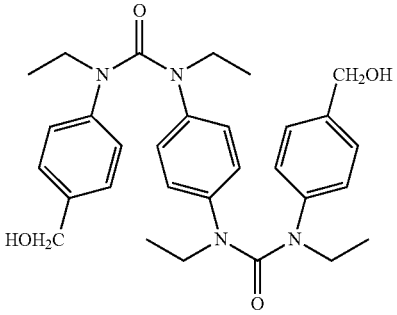
(B-3)
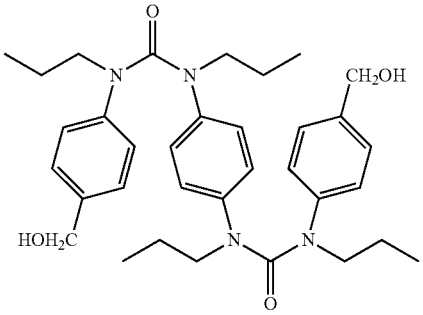
(B-4)
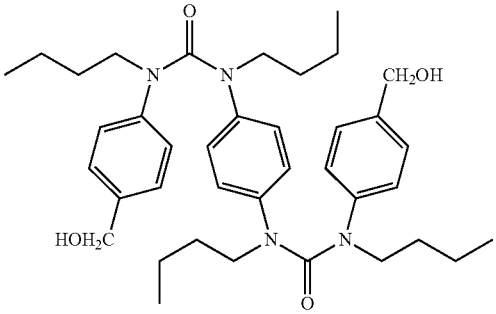
-continued
(B-5)
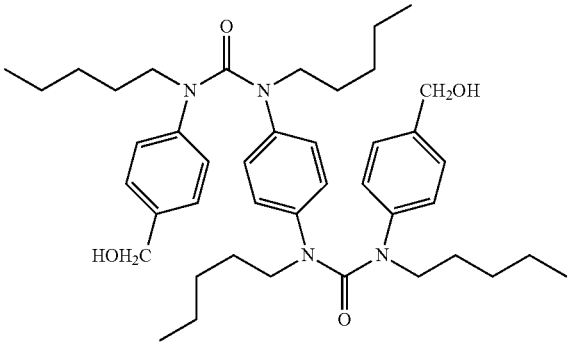
(B-6)
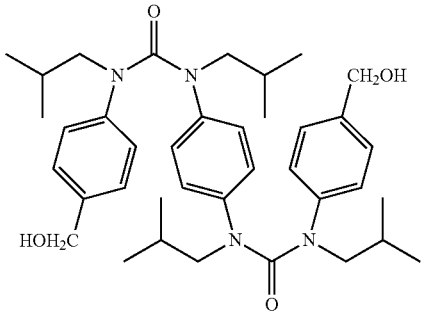
(B-7)
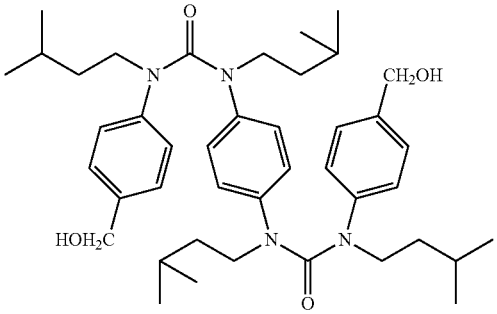
(B-8)
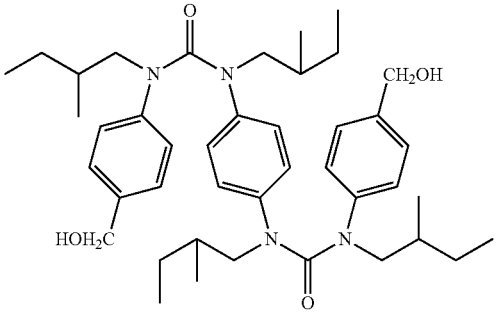
(B-9)
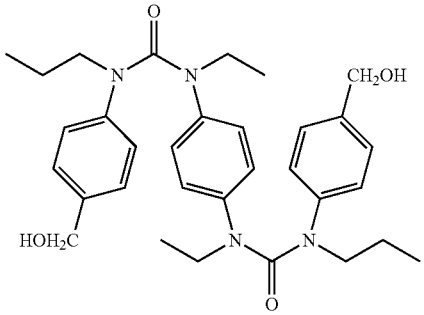

-continued (B-10)

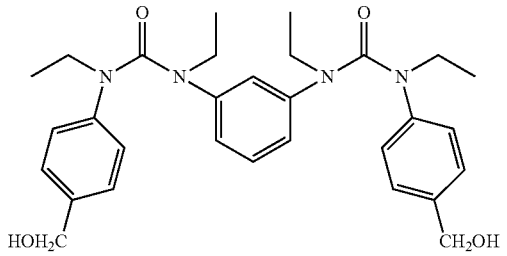

(B-11)

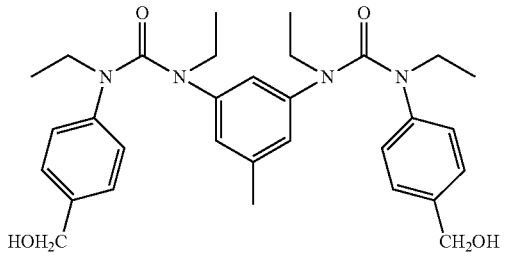

(B-12)

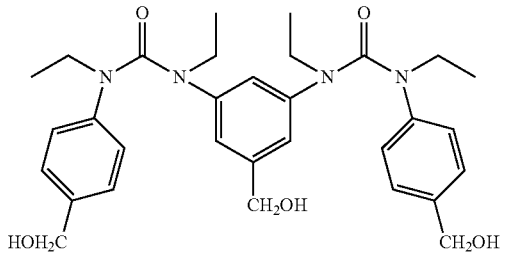

(B-13)

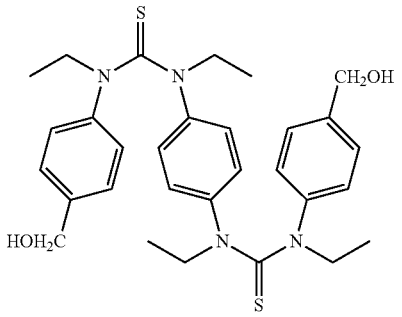

(C-1)

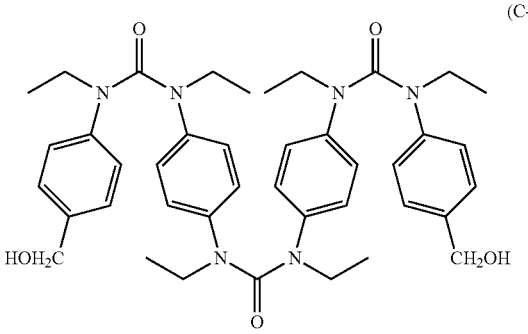

-continued (D-1)

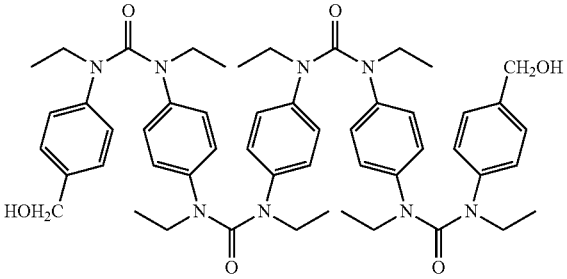

<<Layered structure of Electrophotographic Photosensitive Member>>

The electrophotographic photosensitive member according to the present exemplary embodiment is an electrophotographic photosensitive member including a support and a photosensitive layer formed on the support.

Figure 1B:
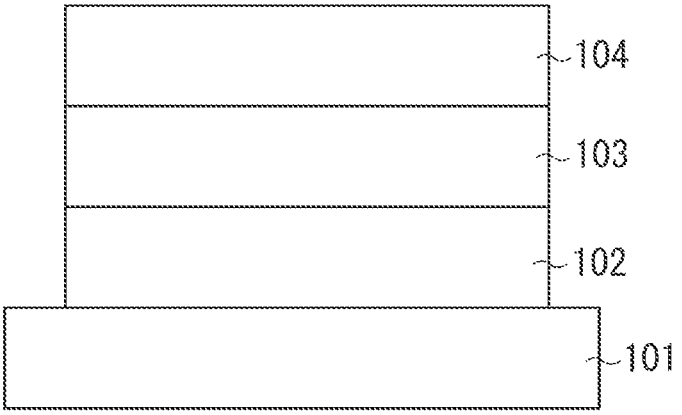
FIG. 1B illustrates another example of the layered structure of the electrophotographic photosensitive member according to the exemplary embodiment.

FIG. 1A illustrates an example of a layered structure of the electrophotographic photosensitive member according to the present exemplary embodiment. Moreover, FIG. 1B illustrates another example of a layered structure of the electrophotographic photosensitive member according to the present exemplary embodiment.

In FIGS. 1A and IB, there are illustrated a support 101, a charge generating layer 102, charge transporting layer (first charge transporting layer) 103, and a protective layer (second charge transporting layer) 104 having a charge transporting capability and serving also as a charge transporting layer.

Thus, the photosensitive layer in the present exemplary embodiment can have a two-layer structure including the charge generating layer 102 and the protective layer 104, which serves also as charge transporting layer, or can have a three-layer structure including the charge generating layer 102, the first charge transporting layer 103, and the protective layer 104, which serves also as a second charge transporting layer.

Additionally, the present exemplary embodiment is not limited to such a layered structure.

Furthermore, in the present exemplary embodiment, a conductive layer or an undercoat layer, described below, can be provided between the support 101 and the photosensitive layer as needed.

In the present exemplary embodiment, the surface layer of the electrophotographic photosensitive member refers to a layer located at the outermost surface (a layer located farthest from the support 101) among the layers included in the electrophotographic photosensitive member. For example, in the case of the electrophotographic photosensitive member having the layered structure illustrated in FIG. 1A, the surface layer of the electrophotographic photosensitive member is the protective layer 104. Moreover, in the case of the electrophotographic photosensitive member having the layered structure illustrated in FIG. 1B, the surface layer of the electrophotographic photosensitive member is the protective layer (second charge transporting layer) 104. In both the examples illustrated in FIGS. 1A and 1B, the protective layer located farthest from the support 101 is a surface layer of the electrophotographic photosensitive member.

<<Support>>

The support for use in the electrophotographic photosensitive member according to the present exemplary embodiment is desirably the one having (electrical) conductivity (a conductive support (an electrical conductive support)), and includes, for example, a support made from metal (alloy), such as aluminum, an aluminum alloy, or stainless steel. In the case of a support made from aluminum or an aluminum alloy, an extrusion drawing (ED) tube, an extrusion ironing (EI) tube, or a tube produced by performing cutting, electrolytic composite polishing, and dry or wet honing processing on the above-mentioned tube can be used as the support. Examples of the support used in the present exemplary embodiment also include a metal support and a resin support on which a thin film made from a conductive material, such as aluminum, an aluminum alloy, or an indium oxide-tin oxide alloy is formed.

The surface of the support can be subjected to cutting, surface roughening, or alumite treatment.

Moreover, examples of the support used in the present exemplary embodiment also include a support on which a conductive layer including a resin and conductive particles dispersed in the resin, such as carbon black, tin oxide particles, titanium oxide particles, or silver particles, is formed, and a support made from a conductive resin.

<<Conductive Layer>>

For the purpose of preventing interference fringes from occurring due to scattering caused by, for example, a laser or for the purpose of covering flaws of the support, a conductive layer can be provided between the support and the photosensitive layer or the undercoat layer.

The conductive layer can be formed by forming a coating film using a conductive layer coating solution, which is obtained by dispersing conductive particles together with a binder resin and a solvent, and drying and/or curing the formed coating film.

Examples of the conductive particles include carbon black such as acetylene black, particles of a metal such as aluminum, nickel, iron, Nichrome, copper, zinc, or silver, and particles of a metal oxide such as tin oxide, zinc oxide, titanium oxide, or indium tin oxide (ITO).

Examples of the binder resin used in the conductive layer include a polyvinyl alcohol resin, a poly-N-vinyl imidazole resin, a polyethylene oxide resin, a polyamide-imide resin, a polyamide resin, a nylon resin, a phenolic resin, a urethane resin, an epoxy resin, an acrylic resin, a melamine resin, a polyester resin, a butyral resin, a phenoxy resin, an acetal resin, and a polycarbonate resin. These resins can be used alone, or can be in a mixture or in the form of a copolymer of two or more resins.

Examples of the solvent for the conductive layer coating solution include an ether-based solvent, an alcohol-based solvent, a ketone-based solvent, and an aromatic hydrocarbon-based solvent.

The film thickness of the conductive layer is desirably 0.1 μm or more and 100 μm or less, and is more desirably 10 μm or more and 50 μm or less.

<<Undercoat Layer>>

An undercoat layer can be provided between the support or the conductive layer and the photosensitive layer. In other words, an undercoat layer (intermediate layer) can be provided between the support or the conductive layer and the charge generating layer, which is a layer closest to the support in the photosensitive layer.

The undercoat layer can be formed by applying an undercoat layer coating solution, which is obtained by dissolving a binder resin in a solvent, to form a coating film and then drying and/or curing the formed coating film.

Examples of the binder resin used in the undercoat layer include a polyvinyl alcohol resin, a poly-N-vinyl imidazole resin, a polyethylene oxide resin, a polyamide-imide resin, a polyamide resin, a nylon resin, a phenolic resin, a urethane resin, an epoxy resin, an acrylic resin, a melamine resin, a polyester resin, a butyral resin, a phenoxy resin, an acetal resin, and a polycarbonate resin. These resins can be used alone, or can be used in a mixture or in the form of a copolymer of two or more resins.

Moreover, the undercoat layer can contain metal oxide particles. Examples of the metal oxide particles include particles containing titanium oxide, zinc oxide, tin oxide, zirconium oxide, or aluminum oxide. Additionally, the metal oxide particles can be metal oxide particles the surface of each of which is treated with a surface preparation agent, such as a silane coupling agent.

Examples of the solvent used in the undercoat layer coating solution include an ether-based solvent, an alcohol-based solvent, a ketone-based solvent, and an aromatic hydrocarbon-based solvent.

The film thickness of the undercoat layer is desirably 0.1 μm or more and 100 μm or less, and is more desirably 10 μm or more and 50 μm or less. Moreover, the undercoat layer can contain organic resin particulates or a leveling agent.

<<Photosensitive Layer>>

A photosensitive layer (a charge generating layer, a charge transporting layer, and a protective layer) is formed on the support, the conductive layer, or the undercoat layer.

<<Charge Generating Layer>>

The charge generating layer in the electrophotographic photosensitive member according to the present exemplary embodiment can be formed by forming a coating film using a charge generating layer coating solution, which is obtained by dispersing a charge generating substance together with a binder resin and a solvent, and drying the formed coating film. Moreover, the charge generating layer can be a vapor-deposited film of the charge generating substance.

Examples of the charge generating substance include pyrylium dyes, thiapyrylium dyes, phthalocyanine pigments, antanthrone pigments, dibenzpyrenequinone pigments, pyranthrone pigments, azo pigments, indigoid pigments, quinacridone pigments, and quinocvanine pigments. Among these substances, phthalocyanine pigments are desirable, and gallium phthalocyanine pigments are more desirable. Moreover, hydroxy gallium phthalocyanine pigments are desirable from the viewpoint of high sensitivity.

Examples of the binder resin used in the charge generating layer include a polyvinyl alcohol resin, a poly-N-vinyl imidazole resin, a polyethylene oxide resin, a polyamide-imide resin, a polyamide resin, a nylon resin, a phenolic resin, a urethane resin, an epoxy resin, an acrylic resin, a melamine resin, a polyester resin, a butyral resin, a phenoxy resin, an acetal resin, and a polycarbonate resin. These resins can be used alone, or can be used in a mixture or in the form of a copolymer of two or more resins.

In the charge generating layer, it is desirable that the proportion of the binder resin to the charge generating substance is set such that the binder resin is 0.1 parts by mass or more and 10 parts by mass or less per part by mass of the charge generating substance.

Furthermore, examples of the method of dispersing include methods using a homogenizer, ultrasonic wave, a ball mill, a sand mill, an attritor, and a roll mill.

Examples of the solvent used in the charge generating layer coating solution include an alcohol-based solvent, a sulfoxide-based solvent, a ketone-based solvent, an ether-based solvent, an ester-based solvent, and an aromatic hydrocarbon-based solvent.

The film thickness of the charge generating layer is desirably 0.01 μm or more and 10 μm or less, and is more desirably 0.1 μm or more and 1 μm or less.

Moreover, various sensitizers, antioxidants, ultraviolet absorbers, and plasticizers can be added to the charge generating layer as needed.

<<<Charge Transporting Layer (First Charge Transporting Layer) >>>

The charge transporting layer in the electrophotographic photosensitive member according to the present exemplary embodiment can be formed by applying a charge transporting layer coating solution, which is obtained by dissolving a charge transporting compound and a binder resin in a solvent, to form a coating film and then drying the formed coating film.

Examples of the charge transporting compound used in the charge transporting layer include a triarylamine compound, a benzidine compound, a hydrazone compound, a stilbene compound, a pyrazoline compound, an oxazole compound, and a thiazole compound.

Examples of the binder resin used in the charge transporting layer include a polyvinyl alcohol resin, a imidazole resin, a polyethylene oxide resin, a polyamide-imide resin, a polyamide resin, a nylon resin, a phenolic resin, a urethane resin, an epoxy resin, an acrylic resin, a melamine resin, a polyester resin, a butyral resin, a phenoxy resin, an acetal resin, and a polycarbonate resin. These resins can be used alone, or can be used in a mixture or in the form of a copolymer of two or more resins.

It is desirable that the proportion of the charge transporting compound is set such that the charge transporting compound is 10 parts by mass or more and 90 parts by mass or less with respect to the entire mass of the charge transporting layer.

Examples of the solvent used in the charge transporting layer coating solution include an ether-based solvent, an alcohol-based solvent, a ketone-based solvent, and an aromatic hydrocarbon-based solvent.

The film thickness of the charge transporting layer is desirably 1 μm or more and 100 μm or less.

Moreover, various sensitizers, antioxidants, ultraviolet absorbers, and plasticizers can be added to the charge transporting layer as needed.

<<<Protective Layer (Second Charge Transporting Layer)>>>

The protective layer in the electrophotographic photosensitive member according to the present exemplary embodiment can be formed in the following way.

First, a protective layer coating solution is obtained by dissolving, in a solvent, at least one compound (i) selected from the group consisting of a triphenylamine compound having a hydroxymethyl group and a benzidine compound having a hydroxymethyl group, and at least one compound (ii) selected from the group consisting of compounds represented by the formulae (1) to (4).

Then, the protective layer coating solution is used to form a coating film on the support the electrophotograpic photosensitive member in which intended layers have previously been formed, and a composition obtained by thermal polymerization reaction of the coating film is copolymerized to obtain a three-dimensional cross-linked product (cured product), so that the protective layer can be formed.

The hydroxymethyl group included in each of the triphenylamine compound having a hydroxymethyl group and the benzidine compound having a hydroxymethyl group can be in a state of being protected by an appropriate protective group. In that case, in cawing a step-growth polymerization reaction for obtaining a cured product, the group needs to separate from the protective group and return to a hydroxymethyl group before the step-growth polymerization reaction. The states of the hydroxymethyl group being protected by a protective group include, for example, the above-cited structures (a') to (k'), but the present exemplary embodiment not limited to those.

In addition to the at least one compound selected from the group consisting of a triphenylamine compound having a hydroxymethyl group and a benzidine compound having a hydroxymethyl group and the at least one compound selected from the group consisting of compounds represented by the formulae (1) to (4), another step-growth polymerizable compound can be mixed into the protective layer.

Examples of another step-growth polymerizable compound include an isocyanate compound, a phenol compound having a hydroxymethyl group, a melamine compound having a hydroxymethyl group, and a guanamine having a hydroxymethyl group. The hydroxymethyl group can be in a state of being protected by an appropriate protective group. In that case, in causing a step-growth polymerization reaction for obtaining a cured product, the group needs to separate from the protective group and return to a hydroxymethyl group before the step-growth polymerization reaction. The states of the hydroxymethyl group being protected by a protective group include, for example, the above-cited structures (a') to (k'), but the present exemplary embodiment not limited to those.

It is desirable that at least one compound (iii) selected from the group consisting of a melamine compound having a hydroxymethyl group and a guanamine compound having a hydroxymethyl group be mixed in terms of being capable of effectively preventing oxidation caused by a discharge product and preventing image smearing.

It is desirable that a compound selected from the group consisting of compounds represented by the formulae (1) to (4) in the composition be used such that the proportion of the compound is 10% by mass or more and 50% by mass or less with respect to the entire constituent material of the protective layer.

Examples of the solvent used in the protective layer coating solution include an alcohol-based solvent, such as methanol, ethanol, propanol, isopropanol, 1-butanol, 2-butanol, and 1-methoxy-2-propanol, a ketone-based solvent, such as acetone, methyl ethyl ketone, and cyclohexanone, an ester-based solvent, such as ethyl acetate and butyl acetate, an ether-based solvent, such as tetrahydrofuran and dioxane, a halogen-based solution, such as 1,1,2,2,3,3,4-Heptafluorocyclopentane, dichloromethane, dichloroethane, and chlorobenzene, an aromatic-based solvent, such as benzene, toluene, and xylene, and a cellosolve-based solvent, such as methyl cellosolve and ethyl cellosolve. These solvents can be used alone, or can be used in a mixture of two or more solvents.

The film thickness of the protective layer is desirably 1 μm or more and 50 μm or less.

Various additives can be added to the protective layer coating solution. Examples of the additive include a deterioration inhibitor, such as antioxidant and ultraviolet absorber, a lubricant, such as polytetrafluoroethylene (PTFE) particles, carbon fluoride, and metal oxide particles, a leveling agent, such as silicone oil, a surfactant, and a curing catalyst.

Moreover, it is desirable that the protective layer contain a triphenylamine compound having no hydroxymethyl group or a benzidine compound having no hydroxymethyl group. This enables a charge transporting compound that does not contribute to cross-linkage to fill micro gaps formed in the cured product by the detachment of water molecules when a step-growth polymerization reaction is caused at a hydroxymethyl group, so that the deterioration of electrical characteristics can be prevented.

Furthermore, in terms of reducing film shrinkage at the time of a step-growth polymerization reaction and preventing the deterioration of electrical characteristics, it is desirable that a triphenylamine compound having a group represented by the following formula (5) or a benzidine compound having a group represented by the following formula (5) be contained in the protective layer such that the compound is 6% by mass or more and 20% by mass or less with respect to the entire amount of solid content in the protective layer coating solution. If the amount of content in the protective layer (in the surface layer) is less than 6% by mass, the above-mentioned effect of preventing the deterioration of electrical characteristics cannot be sufficiently attained in some cases, and, if the amount of content exceeds 20% by mass, the mechanical strength of the protective layer may decrease.

(5)

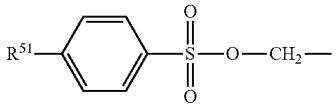

In the formula (5), $R^{51}$ represents a straight-chain alkyl group with a carbon number of 20 or less.

An acid-based catalyst is desirable as the curing catalyst.

Examples of the acid-based catalyst include aliphatic carboxylic acid, such as acetic acid, chloroacetic acid, trichloroacetic acid, trifluoroacetic acid, oxalic acid, maleic acid, malonic acid, and lactic acid, aromatic carboxylic acid, such as benzoic acid, phthalic acid, terephthalic acid, and trimellitic acid, fatty series, such as methanesulfonic acid, dodecyl sulfonic acid, benzenesulfonic acid, dodecylbenzenesulfonic acid, and. naphthalenesulfonic acid, and aromatic sulfonic acids. These curing catalysts can be used alone, or can be used in a mixture of two or more curing catalysts.

Examples of the curing catalyst on the market include "NACURE 2501" (toluene sulfonic acid dissociation, methanol/isopropanol solvent, pH 6.7 or more and pH 7.2 or less, dissociation temperature 80° C.), "NACURE 2107" (p-toluene sulfonic acid dissociation, isopropanol solvent, pH 8.0 or more and pH 9.0 or less, dissociation temperature 90° C.), "NACURE 2500" (p-toluene sulfonic acid dissociation, isopropanol solvent, pH 6.0 or more and pH 7.0 or less, dissociation temperature 65° C.), "NACURE 2530" (p-toluene sulfonic acid dissociation, methanol/isopropanol solvent, pH 5.7 or more and pH 6.5 or less, dissociation temperature 65° C.), "NACURE 2547" (p-toluene sulfonic acid dissociation, aqueous solution, pH 8.0 or more and pH 9.0 or less, dissociation temperature 107° C.), "NACURE 2558" (p-toluene sulfonic acid dissociation, ethylene glycol solvent, pH 3.5 or more and pH 4.5 or less, dissociation temperature 80° C.), "NACURE XP-357" (p-toluene sulfonic acid dissociation, methanol solvent, pH 2.0 or more and pH 4.0 or less, dissociation temperature 65° C.), "NACURE XP-386" (p-toluene sulfonic acid dissociation, aqueous solution, pH. 6.1 or more and pH 6.4 or less, dissociation temperature 80° C.), "NACURE XC-2211" (p-toluene sulfonic acid dissociation, pH 7.2 or more and pH 8.5 or less, dissociation temperature 80° C.), "NACURE 5225" (dodecylbenzenesulfonic acid dissociation, isopropanol solvent, pH 6.0 or more and pH 7.0 or less, dissociation temperature 120' C), "NACURE 5414" (dodecylbenzenesulfonic acid dissociation, xylene solvent, dissociation temperature 120° C.), "NACURE 5528" (dodecylbenzenesulfonic acid dissociation, isopropanol solvent, pH 7.0 or more and. pH 8.0 or less, dissociation temperature 120° C.), "NACURE 5925" (dodecylbenzenesulfonic acid dissociation, pH 7.0 or more and pH 7.5 or less, dissociation temperature 130° C.), "NACURE 1323" (dinonylnaphthalene sulfonic acid dissociation, xylene solvent, pH 6.8 or more and pH 7.5 or less, dissociation temperature 150° C.), "NACURE 1419" (dinonylnaphthalene sulfonic acid dissociation, xylene/methyl isobutyl ketone solvent, dissociation temperature 150° C.), "NACURE 1557" (dinonyinaphthalene sulfonic acid dissociation, butahol/2-butoxyethanol solvent, pH 6.5 or more and pH 7.5 or less, dissociation temperature 150° C.), "NACURE X49-110" (dinonylnaphthalene disulfonic acid dissociation, isobutanol/isopropanol solvent, pH 6.5 or more and pH 7.5 or less, dissociation temperature 90° C.), "NACURE 3525" (dinonylnaphthalene disulfonic acid dissociation, isobutanol/isopropanol solvent, pH 7.0 or more and pH 8.5 or less, dissociation temperature 120° C.), "NACURE XP-383" (dinonylnaphthalene disulfonic acid dissociation, xylene solvent, dissociation temperature 120° C.), "NACURE 3327" (dinonylnaphthalene disulfonic acid dissociation, isobutanol/isopropanol solvent, pH 6.5 or more and pH 7.5 or less, dissociation. temperature 150° C.), "NACURE 4167" (phosphoric acid dissociation, isopropanol/isobutanol solvent, pH 6.8 or more and. pH 7.3 or less, dissociation temperature 80° C.), "NACURE XP-297" (phosphoric acid dissociation, water/isopropanol solvent, pH 6.5 or more and pH 7.5 or less, dissociation temperature 90° C.), and "NACURE 4575" (phosphoric acid dissociation, pH 7.0 or more and pH 8.0 or less, dissociation temperature 110° C.), all of which are manufactured by King Industries Inc.

The amount of blending of the curing catalyst is desirably 0.01 parts by mass or more and 20 parts by mass or less, and, in particular, desirably 0.1 parts by mass or more and 10 parts by mass or less, with respect to 100 parts by mass of solid content in the protective layer coating solution.

The protective layer coating solution is applied onto the charge generating layer or the first charge transporting layer by methods such as a blade coating method, a Meyer bar coating method, a spray coating method, a dipping coating method, a bead coating method, an air knife coating method, and a curtain coating method, and is then heated at, for example, 100° C. or higher and 170° C. or lower, as needed, so that the protective layer is obtained.

The surface of the surface layer (protective layer) can be subjected to surface treatment by using various methods to be formed in an intended shape.

<Electrophotographic Apparatus and Process Cartridge>

Figure 2:
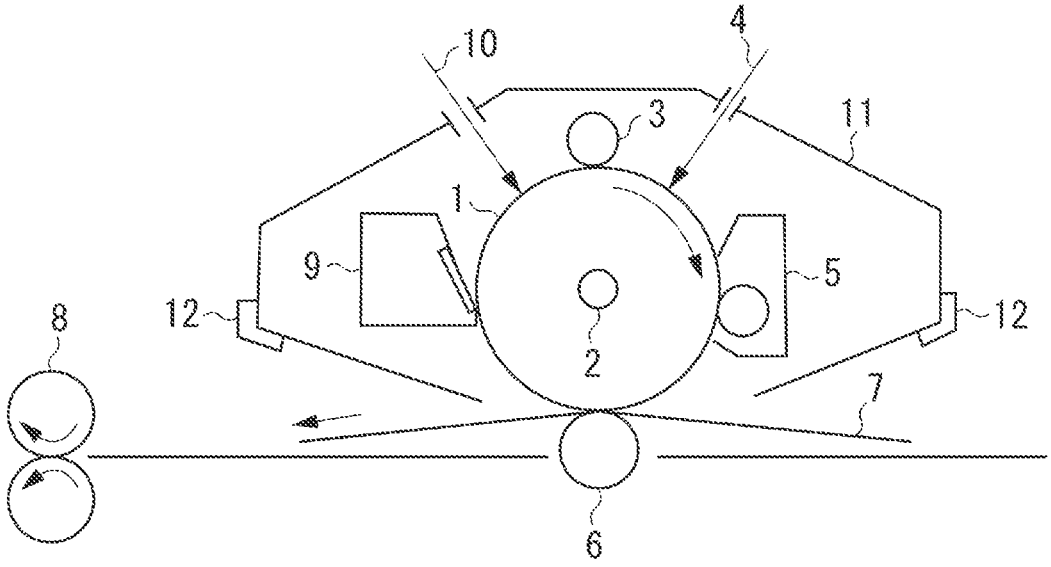
FIG. 2 illustrates an example of a schematic configuration of an electrophotographic apparatus equipped with a process cartridge including an electrophotographic photosensitive member according to an exemplary embodiment.

FIG. 2 illustrates an example of a schematic configuration of an electrophotographic apparatus equipped with a process cartridge including an electrophotographic photosensitive member according to an exemplary embodiment.

Referring to FIG. 2, a cylindrical (drum-shaped) electrophotographic photosensitive member 1 is driven to rotate around a shaft 2 in a direction indicated by an arrow (clockwise direction) at a predetermined circumferential velocity (process speed). In the rotational process of the electrophotographic photosensitive member 1, the surface (peripheral surface) thereof is positively or negatively charged by a charging unit (primary charging unit) 3. Then, the surface of the electrophotographic photosensitive member 1 is irradiated with exposure light (image exposure light) 4 emitted from an exposure unit (image exposure unit) (not illustrated). The exposure light 4 is modulated in intensity according to a time-series electrical digital image signal representing intended image information. The exposure unit uses, for example, slit exposure or laser beam scanning exposure. In this way, an electrostatic latent image corresponding to the intended image information is formed on the surface of the electrophotographic photosensitive member 1.

The electrostatic latent image formed on the surface of the electrophotographic photosensitive member 1 is developed (subjected to normal development or reversal development) with toner stored in a developing unit 5 to form a toner image on the surface of the electrophotographic photosensitive member 1. The toner image formed on the surface of the electrophotographic photosensitive member 1 is transferred to a transfer material 7 by a transfer unit 6. In this process, in a case where the transfer material 7 is paper, the transfer material 7 is fed from a paper feeding unit (not illustrated) and is then transported to between the electrophotographic photosensitive member 1 and the transfer unit 6 in synchronization with the rotation of the electrophotographic photosensitive member 1. Moreover, a bias voltage having a polarity opposite to the carried charge of the toner is applied to the transfer unit 6 from a bias supply (not illustrated).

Furthermore, the transfer unit 6 can be an intermediate transfer type transfer unit including a primary transfer member, an intermediate transfer member, and a secondary transfer member. In the case of the intermediate transfer type transfer unit, a toner image formed on the electrophotographic photosensitive member is primarily transferred onto the intermediate transfer member by the primary transfer member, and is then secondarily transferred from the intermediate transfer member onto the transfer material by the secondary transfer member. In the case of a full-color electrophotographic apparatus using the intermediate transfer type transfer unit, toner images having respective colors are superimposed on each other (subjected to primary transfer) on the intermediate transfer member by the primary transfer member, and are then collectively transferred (subjected to secondary transfer) onto the transfer material by the secondary transfer member, so that a full-color toner image is formed on the transfer material.

The transfer material 7 with the toner image transferred thereto is separated from the surface of the electrophotographic photosensitive member 1 and is then conveyed to a fixing unit 8 to be subjected to fixing treatment of the toner image, so that the transfer material 7 is discharged as an image-formed product (print or copy) to the outside of the electrophotographic apparatus.

After the transfer of the toner image, the surface of the electrophotographic photosensitive member 1 is cleaned by a cleaning unit 9 removing substances, such as non-transfer residual toner, adhering thereto. The non-transfer residual toner can also be collected by, for example, the developing unit 5. Moreover, where appropriate, the surface of the electrophotographic photosensitive member 1 subjected to removal of electricity by being irradiated with pre-exposure light 10 emitted from a pre-exposure unit (not illustrated) and is then repeatedly used for formation of images. Moreover, in a case where the charging unit 3 is a contact charging unit in which, for example, a charging roller is used, the pre-exposure unit is not necessarily provided.

In the present exemplary embodiment, the electrophotographic photosensitive member 1 and at least one of components selected from, for example, the charging unit 3, the developing unit 5, the transfer unit 6, and the cleaning unit 9 can be integrally housed in a container to form a process cartridge. Moreover, such a process cartridge can be configured to be detachably attachable to the main body of the electrophotographic apparatus. For example, the electrophotographic photosensitive member 1 and at least one unit selected from the group consisting of the charging unit 3, the developing unit 5, the transfer unit 6, and the cleaning unit 9 can be integrally housed to form a cartridge, which thus serves as a process cartridge 11 that is able to be attached to and detached from the main body of the electrophotographic apparatus via a guide unit 12, as a rail, of the main body of the electrophotographic apparatus.

Furthermore, the electrophotographic apparatus according to the present exemplary embodiment is not limited to the above-described configuration. In other words, the electrophotographic apparatus according to the present exemplary embodiment is not specifically limited as long as it includes an electrophotographic photosensitive member, a charging unit, an exposure unit, a developing unit, and a transfer unit.

EXAMPLES

Hereinafter, the present exemplary embodiment is described further in detail with reference to examples and comparative examples. Moreover, the term "part" set forth in the examples refers to "part by mass".

Example 1

An aluminum cylinder having a diameter of 30 mm, a length of 357.5 mm, and a wall thickness of 1 mm was used as a support (conductive support).

Next, 100 parts of zinc oxide particles (average particle size 70 nm, manufactured by Tayca Corporation, specific surface area value 15 $m^2/g$), serving as metal oxide particles, were stirred and mixed with 500 parts of toluene, 1.3 parts of a silane coupling agent (KBM603, manufactured by Shin-Etsu Chemical Co., Ltd.) were added to the mixture, and the mixture with the added silane coupling agent was stirred for two hours. Then, after toluene was evaporated under reduced pressure, the mixture was heated at 120° C. for three hours to be dried, so that surface-treated zinc oxide particles were obtained.

110 parts by mass of the surface-treated zinc oxide particles were stirred and mixed with 500 parts by mass of tetrahydrofuran, a solution obtained by dissolving 0.6 parts by mass of alizarin in 50 parts by mass of tetrahydrofuran was added to the mixture, and the mixture with the added solution was stirred at 50° C. for five hours. After that, zinc oxide with alizarin appended thereto was filtered by filtration under reduced pressure and was then dried at 60' C under reduced pressure, so that alizarin-appended zinc oxide was obtained.

Next, 5.7 parts of a butyral resin (trade name: BM-1, manufactured by Sekisui Chemical Co., Ltd.), serving as a polyol resin, and 13.5 parts of blocked isocyanate (trade name: Sumidur 3175, manufactured by Sumika Covestro Urethane Co., Ltd. (formerly Sumika Bayer Urethane Co., Ltd.)), were dissolved in 57.3 parts of methyl ethyl ketone. 60 parts of the above-mentioned alizarin-appended zinc oxide particles were added to the obtained solution, and the solution with the added particles was put in a sand mill device which used glass beads with a diameter of 1 mm, and was subjected to dispersion treatment under an atmosphere of 23±3° C. for two hours. After the dispersion treatment, the solution was added with 0.005 parts by mass of dioctyltin dilaurate, 40 parts by mass of silicone resin. particles (TOSPEARL 145, manufactured by Momentive Performance Materials Japan Inc.), and 0.01 parts of silicone oil (trade name: SH29PA, manufactured by Dow Corning Toray Co., Ltd. (formerly Dow Corning Toray Silicone Co., Ltd.) as catalysts and were stirred, so that an undercoat layer coating solution was prepared.

The prepared undercoat layer coating solution was used to dip-coat the support to form a coating film, and the formed coating film was heated and dried at 170° C. for 40 minutes, so that an undercoat layer with a film thickness of 18 μm was formed.

Next, 15 parts of hydroxygallium phthalocyanine crystal (charge generating substance) having diffraction peaks at least at positions of Bragg angles (2θ±0.2°) of 7.3°, 16.0°, 24.9°, and 28.0° for CuKα characteristic X-ray diffraction, 10 parts of a vinyl chloride-vinyl acetate copolymer resin (VMCH, manufactured by NUC Corporation (formerly Nippon Unicar Company Limited), and 200 parts of n-butyl acetate are mixed, and the obtained solution was put in a sand mill device which used glass beads with a diameter of 1 mm, and was then subjected to dispersion treatment for four hours. After the dispersion treatment, the solution was added with 175 parts by mass of n-butyl acetate and 180 parts by mass of methyl ethyl ketone and was then diluted, so that a charge generating layer coating solution was prepared.

The prepared charge generating layer coating solution was used to dip-coat the undercoat layer to form a coating film, and the formed coating film was dried at ordinary temperature (25° C.), so that a charge generating layer with a film thickness of 0.20 μm was formed.

Next, 45 parts of a charge transporting compound represented by the following formula (A) and 55 parts of polycarbonate (trade name: Lupilon Z400, manufactured by Mitsubishi. Gas Chemical. Company, Inc.) were dissolved in 800 parts of monochlorobenzene, so that a charge transporting layer coating solution was prepared.

(A)

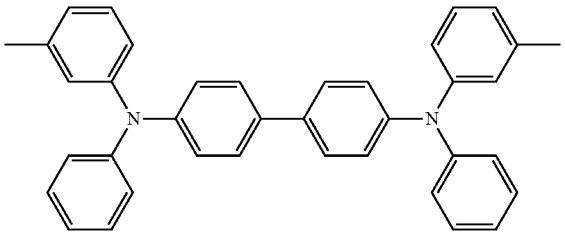

The prepared charge transporting layer coating solution was used to dip-coat the charge generating layer, and the obtained coating film was dried at 130° C. for 45 minutes, so that a charge transporting layer with a film thickness of 15 μm was formed.

Next, 70 parts of a triphenylamine compound having a hydroxymethyl group represented by the following formula (B), 10 parts of a guanamine compound represented by the following formula (C), 20 parts of an exemplary compound (A-2), 1 part by mass of 3,5-di-t-butyl-4-hydroxytoluene (BHT), 0.1 parts by mass of p-toluenesulfonic acid, 30 parts of polytetrafluoroethylene particles (trade name: LUBLON (POLYFLON PTFE Low Polymer) L2, manufactured by Daikin Industries, Ltd.), and 1.5 parts of a resin having a repeated structure unit represented by the following formula (D1) and a repeated structure unit represented by the following formula (D2) (weight-average molecular weight 130,000, (D1)/(D2)=1/1) were added to 150 parts by mass of 1-methoxy-2-propanol, and the resultant solution was subjected to dispersion treatment by an ultrahigh-pressure disperser, so that a protective layer coating solution was prepared. The prepared protective layer coating solution was used to dip-coat the charge transporting layer to form a coating film, and the formed coating film was air-dried at ordinary temperature (25° C.) for 30 minutes and was then heated at 150° C. for one hour to be cured, so that a protective layer with a film thickness of 7 μm was formed, and, as a result, the photosensitive member of Example 1 was produced.

(B)

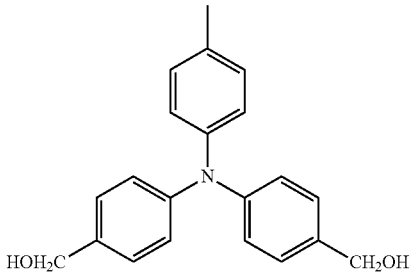

(C)

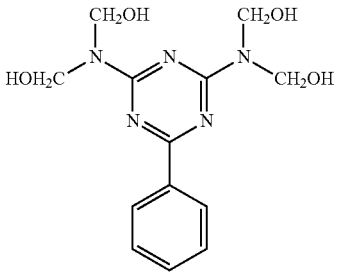

(D1)

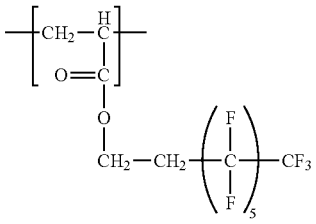

(D2)

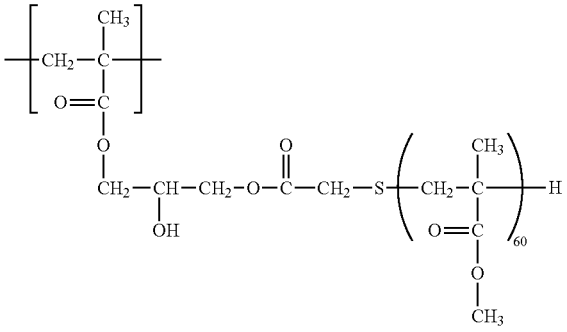

In this way, an electrophotographic photosensitive member including a support, an undercoat layer, a charge generating layer, a charge transporting layer, and a protective layer, in which the protective layer is a surface layer of the electrophotographic photosensitive member, was produced.

Examples 2 to 25

Except that, in Example 1, the exemplary compound (A-2) was changed to respective exemplary compounds set forth in the following Table 1, the respective electro photographic photosensitive members were produced in a similar way to that in Example 1.

TABLE 1

| | Compound to which Compound represented by Exemplary Compound (A-2) was Changed: |
|---|---|
| Example 2 | Exemplary Compound (A-1) |
| Example 3 | Exemplary Compound (A-3) |
| Example 4 | Exemplary Compound (A-4) |
| Example 5 | Exemplary Compound (A-5) |
| Example 6 | Exemplary Compound (A-6) |
| Example 7 | Exemplary Compound (A-7) |
| Example 8 | Exemplary Compound (A-8) |
| Example 9 | Exemplary Compound (A-9) |
| Example 10 | Exemplary Compound (A-10) |
| Example 11 | Exemplary Compound (A-11) |
| Example 12 | Exemplary Compound (A-12) |
| Example 13 | Exemplary Compound (A-13) |
| Example 14 | Exemplary Compound (A-14) |
| Example 15 | Exemplary Compound (A-15) |
| Example 16 | Exemplary Compound (A-16) |
| Example 17 | Exemplary Compound (B-2) |
| Example 18 | Exemplary Compound (B-3) |
| Example 19 | Exemplary Compound (B-4) |
| Example 20 | Exemplary Compound (B-5) |
| Example 21 | Exemplary Compound (B-9) |
| Example 22 | Exemplary Compound (B-10) |
| Example 23 | Exemplary Compound (B-12) |
| Example 24 | Exemplary Compound (C-1) |
| Example 25 | Exemplary Compound (D-1) |

Example 26

Except that, in Example 1, the protective layer coating solution was prepared while the amount of a triphenylamine compound having a hyroxymethyl group represented by the above formula (B) was changed to 84 parts, the amount of a guanamine compound represented by the above formula (C) was changed to 12 parts, and the amount of the exemplary compound (A-2) was changed to 4 parts, the electrophotographic photosensitive member was produced in a similar way to that in Example 1.

Example 27

Except that, in Example 1, the protective layer coating solution was prepared while the amount of a triphenylamine compound having a hydroxymethyl group represented by the above formula (B) was changed to 49 parts, the amount of a guanamine compound represented by the above formula (C) was changed to 7 parts, and the amount of the exemplary compound (A-2) was changed to 44 parts, the electrophotographic photosensitive member was produced in a similar way to that in Example 1.

Example 28

Except that, in Example 1, the protective layer coating solution was cured by being heated at 170° C. for one hour, the electrophotographic photosensitive member was produced in a similar way to that in Example 1.

Example 29

Except that, in Example 28, p-toluenesulfonic acid was not used, the electrophotographic photosensitive member was produced in a similar way to that in. Example 28.

Example 30

Except that, in Example 1, a guanamine compound represented by the above formula (C) was changed to a guanamine compound represented by the following formula (E), the electrophotographic photosensitive member was produced in a similar way to that in Example 1.

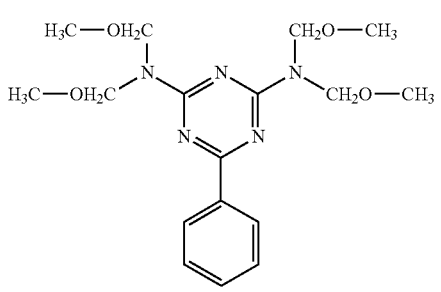

(E)

Example 31

Except that, in Example 1, a guanamine compound represented by the above formula (C) was changed to a guanamine compound represented by the following formula (F), the electrophotographic photosensitive member was produced in a similar way to that in Example 1.

(F)

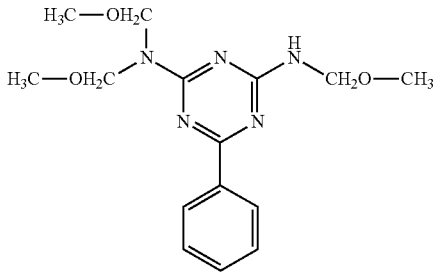

Example 32

Except that, in Example 1, a guanamine compound represented by the above formula (C) was changed to a melamine compound represented by the following formula (G), the electrophotographic photosensitive member was produced in a similar way to that in Example 1.

(G)

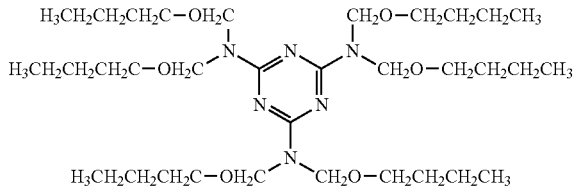

Example 33

Except that, in Example 1, a guanamine compound represented by the above formula (C) was changed to an isocyanate compound represented by the following formula. (H) the electrophotograpnic photosensitive member was produced in a similar way to that in Example 1.

(H)

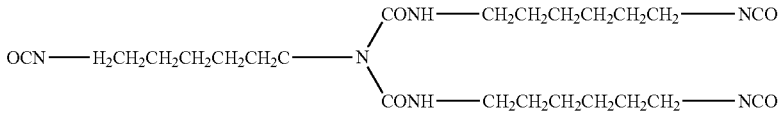

Example 34

Except that, in Example 1, a guanamine compound represented by the above formula (C) was changed to a resol-type curable phenolic resin PE-53123 manufactured by Sumitomo Bakelite Co., Ltd., the electrophotograpnic photosensitive member was produced in a similar way to that in Example 1.

Example 35

Except that, in Example 1, the protective layer coating solution was prepared using 9 parts of a triphenylamine compound having no hydroxymethyl group represented by the following formula (I), the electrophotographic photosensitive member was produced in a similar way to that in Example 1.

(I)

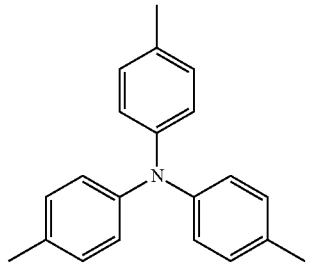

Example 36

Except that, in Example 1, the protective layer coating solution was prepared using 9 parts of a compound represented by the following formula (J), the electrophotographic photosensitive member was produced in a similar way to that in Example 1.

(J)

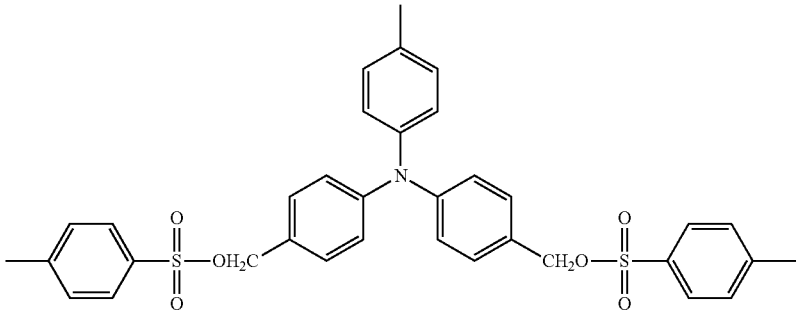

Example 37

Except that, in Example 1, a triphenylamine compound having a hydroxymethyl group represented by the above formula (B) was changed to a triphenylamine compound having a hydroxymethyl group represented by the following formula (K), the electrophotographic photosensitive member was produced in a similar way to that in Example 1.

(K)

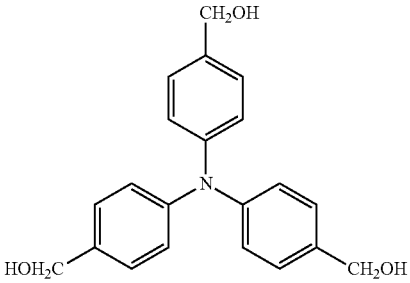

Example 38

Except that, in Example 37, the protective layer coating solution was prepared using 9 parts of a triphenylamine compound having no hydroxymethyl group represented by the above formula (I), the electrophotographic photosensitive member was produced in a similar way to that in Example 37.

Example 39

Except that, in Example 37, the protective layer coating solution was prepared using 9 parts of a compound represented by the following formula (L), the electrophotographic photosensitive member was produced in a similar way to that in Example 37.

(L)

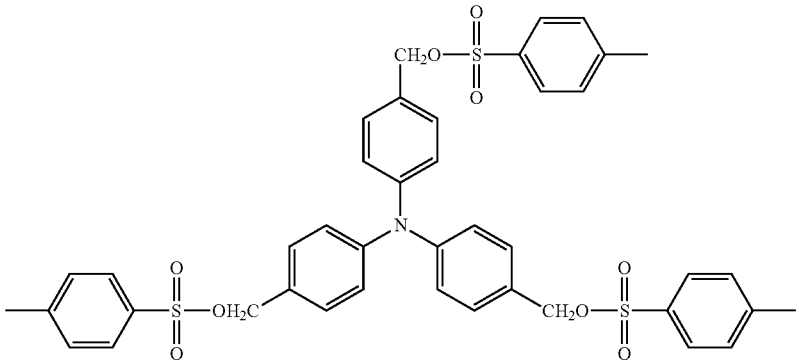

Example 40

Except that, in Example 37, the amount of a triphenylamine compound having a hydroxymethyl group represented by the above formula (K) to be blended into the protective layer coating solution was changed from 70 parts to 80 parts and a guanamine compound represented by the above formula (C) was not used, the electrophotographic photosensitive member was produced in a similar way to that in Example 37.

Example 41

Except that, in Example 1, a triphenylamine compound having a hydroxymethyl group represented by the above formula (B) was changed to a benzidine compound having a hydroxymethyl group represented by the following formula (M), the electrophotographic photosensitive member was produced in a similar way to that in Example 1.

(M)

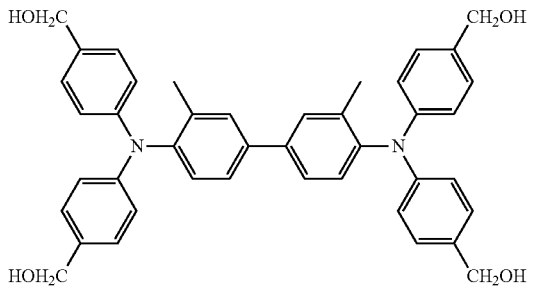

Example 42

Except that, in Example 41, the protective layer coating solution was prepared using 9 parts of a benzidine compound having no hydroxymethyl group represented by the above formula (A), the electrophotographic photosensitive member was produced in a similar way to that in Example 41.

Example 43

Except that, in Example 41, the protective layer coating solution was prepared using 9 parts of a compound represented by the following formula (N), the electrophotographic photosensitive member was produced in a similar way to that in Example 41.

(N)

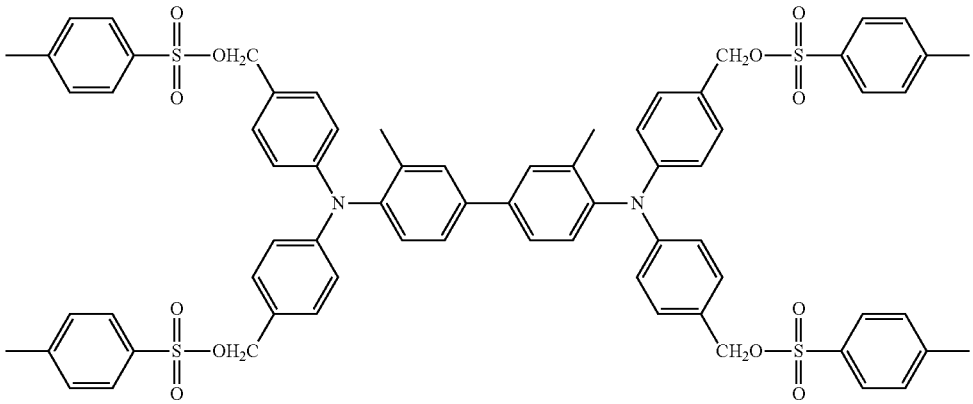

Furthermore, since the electrophotographic photosensitive members in the above-described Examples 1 to 43 allowed the protective layer to be formed under an ordinary oxygen level environment, these were excellent in productivity.

Comparative Example 1

Except that, in Example 1, the amount of a triphenylamine compound having a hydroxymethyl group represented by the above formula (B) to be blended into the protective layer coating solution was changed to 87.5 parts, the amount of a guanamine compound represented by the above formula (C) was changed to 12.5 parts, and the exemplary compound (A-2) was not used, the electrophotographic photosensitive member was produced in a similar way to that in Example 1.

Comparative Example 2

Except that, in Example 1, the exemplary compound (A-2) was changed to a compound represented by the following formula (O), the electrophotographic photosensitive member was produced in a similar way to that in Example 1.

(O)

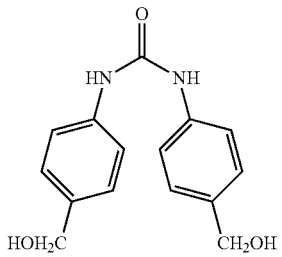

Comparative Example 3

Except that, in Example 1, the exemplary compound (A-2) was changed to a compound represented by the following formula (P), the electrophotographic photosensitive member was produced in a similar way to that in Example 1.

(P)

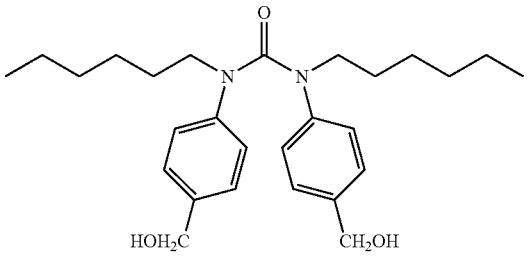

Comparative Example 4

Except that, in Example 1, the exemplary compound (A-2) was changed to a compound represented by the following formula (Q), the electrophotographic photosensitive member was produced in a similar way to that in Example 1.

(Q)

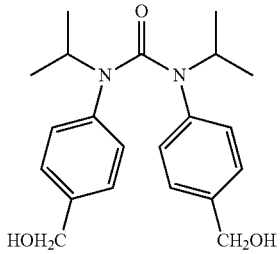

Comparative Example 5

Except that, in Example 1, the exemplary compound (A-2) was changed to a compound represented by the following formula (R), the electrophotographic photosensitive member was produced in a similar way to that in Example 1.

(R)

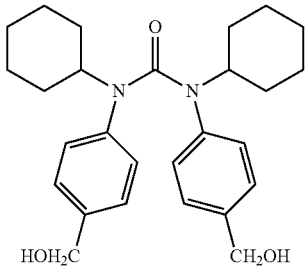

Comparative Example 6

Except that, in Example 1, the exemplary compound (A-2) was changed to a compound represented by the following formula (S), the electrophotographic photosensitive member was produced in a similar way to that in Example 1.

(S)

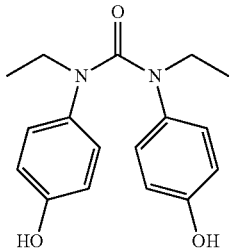

Comparative Example 7

Except that, in Example 1, the exemplary compound (A-2) was changed to a compound represented by the following formula (T), the electrophotographic photosensitive member was produced in a similar way to that in Example 1.

(T)

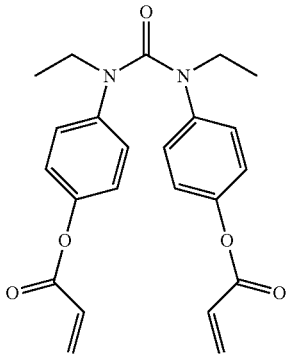

Comparative Example 8

Except that, in Example 1, a triphenylamine compound having a hydroxymethyl group represented by the above formula (B) was changed to a triphenylamine compound having no hydroxymethyl group represented by the above formula (I), the electrophotographic photosensitive member was produced in a similar way to that in Example 1.

(Evaluation)

(Evaluation of Electrical Characteristics)

The method for evaluation of electrophotographic photosensitive members produced in Examples 1 to 43 and Comparative Examples 1 to 8 is as follows.

A copying machine iR-ADVANCE C5051 (trade name) manufactured by Canon Inc. was used as an evaluation apparatus.

First, the electrophotographic photosensitive members were left together with the evaluation apparatus for one day under the environment of a normal temperature of 23° C. and a normal humidity of 50% RH. After that, under the same environment, the charging potential (VD) was adjusted to −700 V and the light area potential (VL) was adjusted to −250 V. Pre-exposure was adjusted in such a way as to obtain a light quantity ten times the light-emitting diode (LED) light quantity that attenuates the charging potential of −800 V to −250 V. After that, the iteration of a cycle of charging, exposure, and pre-exposure (a VL endurance test, in a full-area black image mode) was performed 3,000 rotations in a row without any change of the above-mentioned charging setting, the image-exposure light quantity, the pre-exposure light quantity, and the setting of the process speed. A series of evaluations was all performed under the environment of a normal temperature and a normal humidity. The light area potential (VL) at the 3,000th rotation was measured, and a difference in VL between the initial rotation and the 3,000th rotation was calculated as a potential variation amount ΔVL.

The evaluation result is shown in Table 2.

Moreover, in a case where the potential variation amount is equal to or less than 25 V, it can be determined that the electrophotographic photosensitive member according to the present exemplary embodiment has excellent electrical characteristics.

(Evaluation of Abrasion Loss)

The method for evaluation of electrophotographic photosensitive members produced in Examples 1 to 43 and Comparative Examples 1 to 8 is as follows.

A copying machine iR-ADVANCE C5051 (trade name) manufactured by Canon Inc. was used as an evaluation apparatus. The peak-to-peak voltage and the frequency of an alternating-current component to be applied to a charging roller were set in such a way as to obtain a discharge current amount of 100 μA. Additionally, the voltage of a direct-current component to be applied to the charging roller and the condition for the exposure light quantity of an exposure unit were set in such a way as to obtain an initial dark area potential (Vd) of about −800 V and an initial light area potential (V1) of about −250 V of the electrophotographic photosensitive member.

The electrophotographic photosensitive members were left together with the evaluation apparatus for one day under the environment of a normal temperature of 23° C. and a normal humidity of 50% RH. After that, pre-exposure was adjusted in such a way as to obtain a light quantity ten times the LED light quantity that attenuates the charging potential of −800 V to −250 V. Additionally after that, an image with an image ratio of 5% was output in 100,000 sheets of A4 portrait size paper without any change of the above-mentioned charging setting, the image-exposure light quantity, the pre-exposure light quantity, and the setting of the process speed. The amount of change in film thickness of the photosensitive layer between before and after outputting of images in 100,000 sheets was evaluated as the abrasion loss.

The evaluation result is shown in Table 2.

Moreover, in a case where the abrasion loss is equal to or less than 1.5 μm, it can be determined that the abrasion resistance is adequate. As shown in Table 2, it can be determined that the electrophotographic photosensitive member according to the present exemplary embodiment has excellent abrasion resistance (mechanical strength) as with conventional products.

(Evaluation of Image Smearing)

The method for evaluation of electrophotographic photosensitive members produced in Examples 1 to 43 and Comparative Examples 1 to 8 is as follows.

A copying machine iR-ADVANCE C5051 (trade name) manufactured by Canon Inc. was used as an evaluation apparatus. The peak-to-peak voltage and the frequency of an alternating-current component to be applied to a charging roller were set in such a way as to obtain a discharge current amount of 100 μA. Additionally, the voltage of a direct-current component to be applied to the charging roller and the condition for the exposure light quantity of an exposure unit were set in such a way as to obtain an initial dark area potential (Vd) of about −600 V and an initial light area potential (VI) of about −250 V of the electrophotographic photosensitive member. The evaluation at that time was performed with an environmental heater consistently turned off.

The electrophotographic photosensitive members were left together with the evaluation apparatus for one day under the environment of a high temperature of 30° C. and a high humidity of 80% RH. After that, pre-exposure was adjusted in such a way as to obtain a light quantity ten times the LED light quantity that attenuates the charging potential of −600 V to −250 V. Additionally after that, an image with an image ratio of 2% was output in 2,000 sheets of A4 portrait size paper without any change of the above-mentioned charging setting, the image-exposure light quantity, the pre-exposure light quantity, and the setting of the process speed.

After outputting of Thmages in 2,000 sheets, the evaluation apparatus was powered off and was stopped for one day. After stopping for one day, the evaluation apparatus was powered on again, and was caused to output a lattice image (4 dots) in A4 portrait size paper.

With respect to the obtained images, the effect of preventing image smearing was evaluated according to the following evaluation ranks. The larger the rank number, the more adequate the effect was, and it was determined that the ranks 5, 4, and 3 are levels in which the effect of preventing image smearing in the present exemplary embodiment was attained. On the other hand, it was determined that the ranks 1 and 2 are levels in which the effect of preventing image smearing in the present exemplary embodiment was not attained.

Rank 5: No image defect was found in the lattice image.
Rank 4: A part of the lattice image became paled.
Rank 3: The whole area of the lattice image became paled.
Rank 2: A partial loss was found in the lattice image.
Rank 1: The whole area of the lattice image was lost.

The evaluation result is shown in Table 2.

TABLE 2

| | Potential Variation Amount (V) | Abrasion Loss (μm) | Image Smearing Rank |
|---|---|---|---|
| Example 1 | 20 | 1.2 | 4 |
| Example 2 | 25 | 1.4 | 4 |
| Example 3 | 20 | 1.2 | 4 |
| Example 4 | 20 | 1.4 | 4 |
| Example 5 | 20 | 1.4 | 4 |
| Example 6 | 20 | 1.4 | 4 |
| Example 7 | 20 | 1.4 | 4 |
| Example 8 | 20 | 1.4 | 4 |
| Example 9 | 20 | 1.4 | 4 |
| Example 10 | 20 | 1.4 | 4 |
| Example 11 | 20 | 1.4 | 4 |
| Example 12 | 20 | 1.4 | 4 |
| Example 13 | 20 | 1.4 | 4 |
| Example 14 | 20 | 1.4 | 4 |
| Example 15 | 20 | 1.4 | 4 |
| Example 16 | 20 | 1.4 | 4 |
| Example 17 | 20 | 1.2 | 4 |
| Example 18 | 20 | 1.2 | 4 |
| Example 19 | 20 | 1.4 | 4 |
| Example 20 | 20 | 1.4 | 4 |
| Example 21 | 20 | 1.4 | 4 |
| Example 22 | 20 | 1.4 | 4 |
| Example 23 | 20 | 1.4 | 4 |
| Example 24 | 20 | 1.2 | 4 |
| Example 25 | 20 | 1.2 | 4 |
| Example 26 | 20 | 1.2 | 3 |
| Example 27 | 25 | 1.3 | 5 |
| Example 28 | 20 | 1.2 | 4 |
| Example 29 | 20 | 1.4 | 4 |
| Example 30 | 20 | 1.2 | 4 |

TABLE 2-continued

| | Potential Variation Amount (V) | Abrasion Loss (μm) | Image Smearing Rank |
|---|---|---|---|
| Example 31 | 20 | 1.2 | 4 |
| Example 32 | 20 | 1.2 | 4 |
| Example 33 | 20 | 1.3 | 3 |
| Example 34 | 25 | 1.3 | 3 |
| Example 35 | 15 | 1.3 | 4 |
| Example 36 | 15 | 1.3 | 4 |
| Example 37 | 20 | 1.3 | 4 |
| Example 38 | 15 | 1.3 | 4 |
| Example 39 | 15 | 1.3 | 4 |
| Example 40 | 15 | 1.5 | 4 |
| Example 41 | 20 | 1.3 | 4 |
| Example 42 | 15 | 1.3 | 4 |
| Example 43 | 15 | 1.3 | 4 |
| Comparative Example 1 | 20 | 1.3 | 1 |
| Comparative Example 2 | 35 | 1.2 | 2 |
| Comparative Example 3 | 25 | 1.9 | 3 |
| Comparative Example 4 | 20 | 1.4 | 2 |
| Comparative Example 5 | 20 | 1.4 | 2 |
| Comparative Example 6 | 25 | 2.3 | 3 |
| Comparative Example 7 | 20 | 1.8 | 3 |
| Comparative Example 8 | 25 | 3.0 | 4 |

According to the present disclosure, an electrophotographic photosensitive member that is excellent in productivity and has an adequate mechanical strength, an adequate effect for prevention of image smearing, and adequate electrical characteristics can be provided. Furthermore, according to the present disclosure, a process cartridge and an electrophotographic apparatus each of which includes the above-mentioned electrophotographic photosensitive member can be provided. Moreover, according to the present disclosure, a method for producing an electrophotographic photosensitive member that is excellent in productivity and has an adequate mechanical strength, an adequate effect for prevention of image smearing, and adequate electrical characteristics can be provided.

While the present disclosure has been described with reference to exemplary embodiments, it is to be understood that the invention not limited to the disclosed exemplary embodiments. The scope of the following claims is to be accorded the broadest interpretation so as to encompass all such modifications and equivalent structures and functions.

This application claims the benefit of Japanese Patent Application No. 2015-218926 filed Nov. 6, 2015, which is hereby incorporated by reference herein in its entirety.

What is claimed is:

1. An electrophotographic photosensitive member comprising a support and a photosensitive layer formed on the support, wherein a surface layer of the electrophotographic photosensitive member contains a cured product obtained by copolymerizing:

at one compound (i) selected from the group consisting of a triphenylamine compound having a hydroxymethyl group and a benzidine compound having a hydroxymethyl group; and at least one compound (ii) selected from the group consisting of a compound represented by the following formula (1), a compound represented by the following formula (2), a compound represented by the following formula (3), and a compound represented by the following formula (4):

(1)

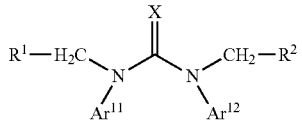

(2)

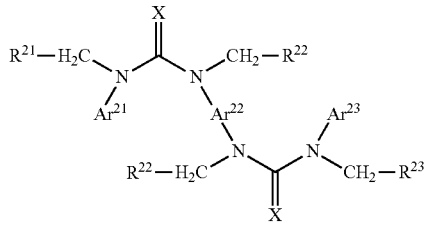

(3)

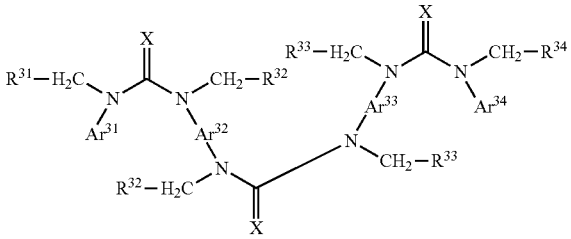

(4)

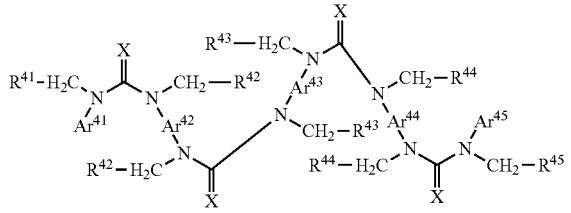

where, in the formulae (1) to (4), X represents an oxygen atom or a sulfur atom, $R^1$, $R^2$, $R^{21}$, $R^{22}$, $R^{23}$, $R^{31}$, $R^{32}$, $R^{33}$, $R^{34}$, $R^{41}$, $R^{42}$, $R^{43}$, $R^{44}$, and $R^{45}$ each independently represent a hydrogen atom or a monovalent group derived by removing one hydrogen atom from a saturated aliphatic hydrocarbon with a carbon number of 4 or less in a straight chain, $Ar^{11}$, $Ar^{12}$, $Ar^{21}$, $Ar^{23}$, $Ar^{31}$, $Ar^{34}$, $Ar^{41}$, and $Ar^{45}$ each independently represent a substituted or unsubstituted aryl group, $Ar^{22}$, $Ar^{32}$, $Ar^{33}$, $Ar^{42}$, $Ar^{43}$, and $Ar^{44}$ each independently represent a substituted or unsubstituted arylene group, a substituent of the aryl group or the arylene group is a group selected from the group consisting of a methyl group and a hydroxymethyl group, at least one of $Ar^{11}$ and $Ar^{12}$ is an aryl group having a hydroxymethyl group as a substituent, at least one of $Ar^{21}$ to $Ar^{23}$ is an aryl group or arylene group having a hydroxymethyl group as a substituent, at least one of $Ar^{31}$ to $Ar^{34}$ is an aryl group or arylene group having a hydroxymethyl group as a substituent, and at least one of $Ar^{41}$ to $Ar^{45}$ is an aryl group or arylene group having a hydroxymethyl group as a substituent.

2. The electrophotographic photosensitive member according to claim 1, wherein the cured product is a cured product obtained by copolymerizing:

the at least one compound (i);

the at least one compound (ii); and at least one compound (iii) selected from the group consisting of a melamine compound having a hydroxymethyl group and a guanamine compound having a hydroxymethyl group.

3. The electrophotographic photosensitive member according to claim 1, wherein, in the formulae (1) to (4), $R^1$, $R^2$, $R^{21}$, $R^{22}$, $R^{23}$, $R^{31}$, $R^{32}$, $R^{33}$, $R^{34}$, $R^{41}$, $R^{42}$, $R^{43}$, $R^{44}$, and $R^{45}$ each independently represent a monovalent group derived by removing one hydrogen atom from a saturated aliphatic hydrocarbon with a carbon number of 4 or less in a straight chain.

4. The electrophotographic photosensitive member according to claim 1, wherein, in the formulae (1) to (4), $R^1$, $R^2$, $R^{21}$, $R^{22}$, $R^{23}$, $R^{31}$, $R^{32}$, $R^{33}$, $R^{34}$, $R^{41}$, $R^{42}$, $R^{43}$, $R^{44}$, and $R^{45}$ each independently represent a methyl group or an ethyl group.

5. The electrophotographic photosensitive member according to claim 1, wherein the surface layer further contains a triphenylamine compound having no hydroxymethyl group, and wherein the at least one compound (i) is a triphenylamine compound having a hydroxymethyl group.

6. The electrophotographic photosensitive member according to claim 1, wherein the surface layer further contains a triphenylamine compound having a group represented by the following formula (5), and wherein an amount of the triphenylamine compound having a group represented by the following formula (5) in the surface layer is 6% by mass or more and 20% by mass or less with respect to an entire amount of solid content in the surface layer, (5)

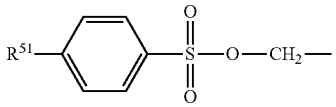

where, in the formula (5), $R^{51}$ represents a straight-chain alkyl group with a carbon number of 20 or less.

7. The electrophotographic photosensitive member according to claim 1, wherein the surface layer further contains a benzidine compound having no hydroxymethyl group, and wherein the at least one compound (i) is a benzidine compound having a hydroxymethyl group.

8. The electrophotographic photosensitive member according to claim 1, wherein the surface layer further contains a benzidine compound having a group represented by the following formula (5), and wherein an amount of the benzidine compound having a group represented by the following formula (5) in the surface layer is 6% by mass or more and 20% by mass or less with respect to an entire amount of solid content in the surface layer, (5)

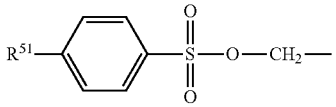

where, in the formula. (5), $R^{51}$ represents a straight-chain alkyl group with a carbon number of 20 or less.

9. A process cartridge configured to integrally support an electrophotographic photosensitive member and at least one unit selected from the group consisting of a charging unit, a developing unit, a transfer unit, and a cleaning unit, and configured to be detachably attachable to a main body of an electrophotographic apparatus, wherein a surface layer of the electrophotographic photosensitive member contains a cured product obtained by copolymerizing:

at least one compound (i) selected from the group consisting of a triphenylamine compound having a hydroxymethyl group and a benzidine compound having a hydroxymethyl group; and at least one compound (ii) selected from the group consisting of a compound represented by the following formula (1), a compound represented by the following formula (2), a compound represented by the following formula (3), and a compound represented by the following formula (4):

(1)

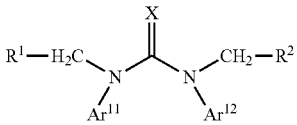

(2)

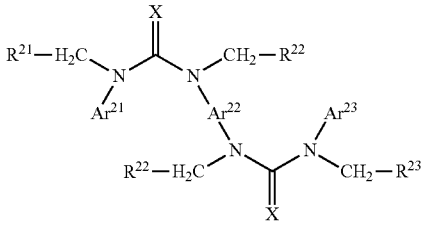

(3)

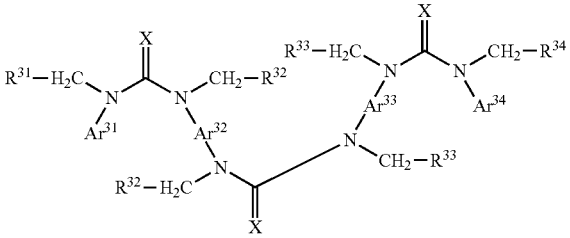

(4)

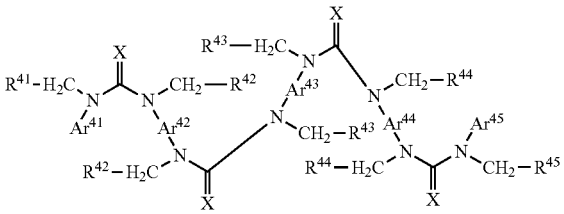

where, in the formulae (1) to (4), X represents an oxygen atom or a sulfur atom, $R^1$, $R^2$, $R^{21}$, $R^{22}$, $R^{23}$, $R^{31}$, $R^{32}$, $R^{33}$, $R^{34}$, $R^{41}$, $R^{42}$, $R^{43}$, $R^{44}$, and $R^{45}$ each independently represent a hydrogen atom or a monovalent group derived by removing one hydrogen atom from a saturated aliphatic hydrocarbon with a carbon number of 4 or less in a straight chain, $Ar^{11}$, $Ar^{12}$, $Ar^{21}$, $Ar^{23}$, $Ar^{31}$, $Ar^{34}$, $Ar^{41}$, and $Ar^{45}$ each independently represent a substituted or unsubstituted aryl group, $Ar^{22}$, $Ar^{32}$, $Ar^{33}$, $Ar^{42}$, $Ar^{43}$, and $Ar^{44}$ each independently represent a substituted or unsubstituted arylene group, a substituent of the aryl group or the arylene group is a group selected from the group consisting of a methyl group and a hydroxymethyl group, at least one of $Ar^{11}$ and $Ar^{12}$ is an aryl group having a hydroxymethyl group as a substituent, at least one of $Ar^{21}$ to $Ar^{23}$ is an aryl group or arylene group having a hydroxymethyl group as a substituent, at least one of $Ar^{31}$ to $Ar^{34}$ is an aryl group or arylene group having a hydroxymethyl group as a substituent, and at least one of $Ar^{41}$ to $Ar^{45}$ is an aryl group or arylene group having a hydroxymethyl group as a substituent.

10. An electrophotographic apparatus comprising an electrophotographic photosensitive member, a charging unit, an exposure unit, a developing unit, and a transfer unit, wherein a surface layer of the electrophotographic photosensitive member contains a cured product obtained by copolymerizing:

at least one compound (i) selected from the group consisting of a triphenylamine compound having a hydroxymethyl group and a benzidine compound having a hydroxymethyl group; and at least one compound (ii) selected from the group consisting of a compound represented by the following formula (1), a compound represented by the following formula (2), a compound represented by the following formula (3), and a compound represented by the following formula (4):

(1)

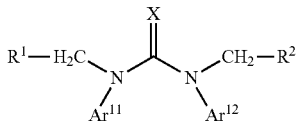

(2)

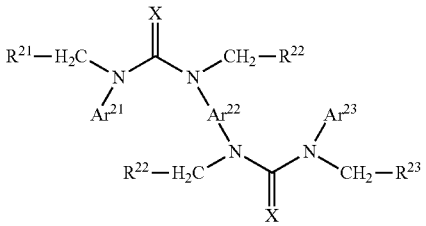

(3)

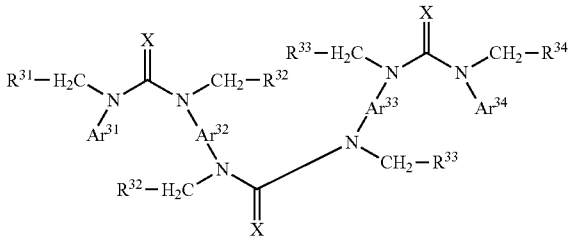

-continued (4)

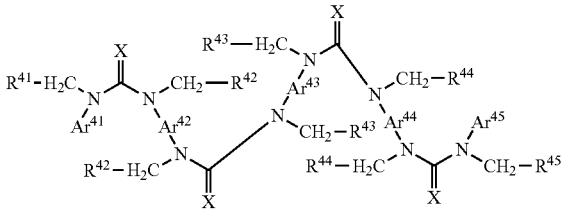

where, in the formulae (1) to (4), X represents an oxygen atom or a sulfur atom, $R^1$, $R^2$, $R^{21}$, $R^{22}$, $R^{23}$, $R^{31}$, $R^{32}$, $R^{33}$, $R^{34}$, $R^{41}$, $R^{42}$, $R^{43}$, $R^{44}$, and $R^{45}$ each independently represent a hydrogen atom or a monovalent group derived by removing one hydrogen atom from a saturated aliphatic hydrocarbon with a carbon number of 4 or less in a straight chain, $Ar^{11}$, $Ar^{12}$, $Ar^{21}$, $Ar^{23}$, $Ar^{31}$, $Ar^{34}$, $Ar^{41}$, and $Ar^{45}$ each independently represent a substituted or unsubstituted aryl group, $Ar^{22}$, $Ar^{32}$, $Ar^{33}$, $Ar^{42}$, $Ar^{43}$, and $Ar^{44}$ each independently represent a substituted or unsubstituted arylene group, a substituent of the aryl group or the arylene group is a group selected from the group consisting of a methyl group and a hydroxymethyl group, at least one of $Ar^{11}$ and $Ar^{12}$ is an aryl group having a hydroxymethyl group as a substituent, at least one of $Ar^{21}$ to $Ar^{23}$ is an aryl group or arylene group having a hydroxymethyl group as a substituent, at least one of $Ar^{31}$ to $Ar^{34}$ is an aryl group or arylene group having a hydroxymethyl group as a substituent, and at least one of $Ar^{41}$ to $Ar^{45}$ is an aryl group or arylene group having a hydroxymethyl group as a substituent.

11. A method for producing an electrophotographic photosensitive member including a support and a photosensitive layer formed on the support, the method comprising:

forming a coating film using a surface layer coating solution containing:

at least one compound (i) selected from the group consisting of a triphenylamine compound having a hydroxymethyl group and a benzidine compound having a hydroxymethyl group; and at least one compound (ii) selected from the group consisting of a compound represented by the following formula (1), a compound represented by the following formula (2), a compound represented by the following formula (3), and a compound represented by the following formula (4); and forming a surface layer of the electrophotographic photosensitive member by copolymerizing the at least one compound (i) and the at least one compound (ii) and curing the coating film, (1)

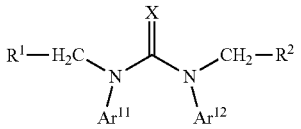

(2)

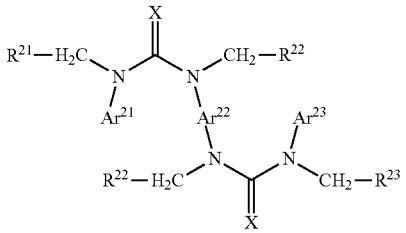

(3)

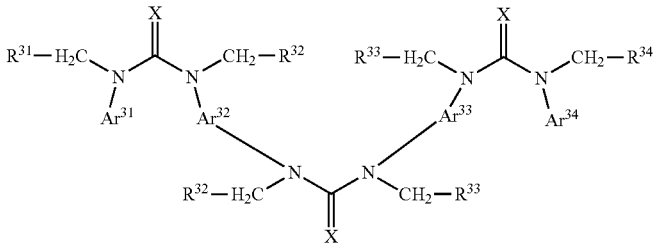

(4)

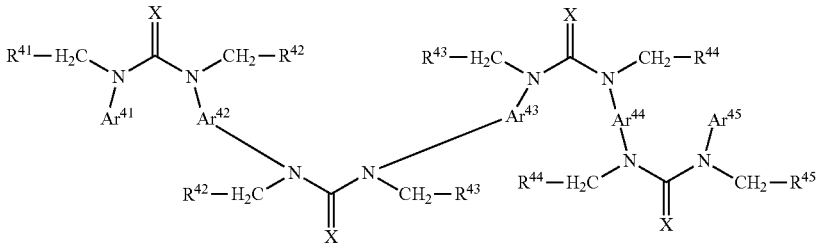

where, in the formulae (1) to (4), X represents an oxygen atom or a sulfur atom, $R^1$, $R^2$, $R^{21}$, $R^{22}$, $R^{23}$, $R^{31}$, $R^{32}$, $R^{33}$, $R^{34}$, $R^{41}$, $R^{42}$, $R^{43}$, $R^{44}$, and $R^{45}$ each independently represent a hydrogen atom or a monovalent group derived by removing one hydrogen atom from a saturated aliphatic hydrocarbon with a carbon number of 4 or less in a straight chain, $Ar^{11}$, $Ar^{12}$, $Ar^{21}$, $Ar^{23}$, $Ar^{31}$, $Ar^{34}$, $Ar^{41}$, and $Ar^{45}$ each independently represent a substituted or unsubstituted aryl group, $Ar^{22}$, $Ar^{32}$, $Ar^{33}$, $Ar^{42}$, $Ar^{43}$, and $Ar^{44}$ each independently represent a substituted or unsubstituted arylene group, a substituent of the aryl group or the arylene group is a group selected from the group consisting of a methyl group and a hydroxymethyl group, at least one of $Ar^{11}$ and $Ar^{12}$ is an aryl group having a hydroxymethyl group as a substituent, at least one of $Ar^{21}$ to $Ar^{23}$ is an aryl group or arylene group having a hydroxymethyl group as a substituent, at least one of $Ar^{31}$ to $Ar^{34}$ is an aryl group or arylene group having a hydroxymethyl group as a substituent, and at least one of $Ar^{41}$ to $Ar^{45}$ is an aryl group or arylene group having a hydroxymethyl group as a substituent.

12. The method according to claim 11, wherein the surface layer coating solution further contains at least one compound (iii) selected from the group consisting of a melamine compound having a hydroxymethyl group and a guanamine compound having a hydroxymethyl group, and wherein forming the surface layer includes forming the surface layer by copolymerizing the at least one compound (i), the at least one compound (ii), and the at least one compound (iii) and curing the coating film.

13. The method according to claim 11, wherein, in the formulae (1) to (4), $R^1$, $R^2$, $R^{21}$, $R^{22}$, $R^{23}$, $R^{31}$, $R^{32}$, $R^{33}$, $R^{34}$, $R^{41}$, $R^{42}$, $R^{43}$, $R^{44}$, and $R^{45}$ each independently represent a monovalent group derived by removing one hydrogen atom from a saturated aliphatic hydrocarbon with a carbon number of 4 or less in a straight chain.

14. The method according to claim 11, wherein, in the formulae (1) to (4), $R^1$, $R^2$, $R^{21}$, $R^{22}$, $R^{23}$, $R^{31}$, $R^{32}$, $R^{33}$, $R^{34}$, $R^{41}$, $R^{42}$, $R^{43}$, $R^{44}$, and $R^{45}$ each independently represent a methyl group or an ethyl group.

15. The method according to claim 11, wherein the surface layer coating solution further contains a triphenylamine compound having no hydroxymethyl group, and wherein the at least one compound (i) is a triphenylamine compound having a hydroxymethyl group.

16. The method according to claim 11, wherein the surface layer coating solution further contains a triphenylamine compound having a group represented by the following formula (5), and wherein an amount of the triphenylamine compound having a group represented by the following formula (5) in the surface layer coating solution is 6% by mass or more and 20% by mass or less with respect to an entire amount of solid content in the surface layer coating solution, (5)

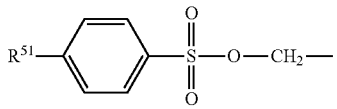

where, in the formula (5), $R^{51}$ represents a straight-chain alkyl group with a carbon number of 20 or less.

17. The method according to claim 11, wherein the surface layer coating solution further contains a benzidine compound having no hydroxymethyl group, and wherein the at least one compound (i) is a benzidine compound having a hydroxymethyl group.

18. The method according to claim 11, wherein the surface layer coating solution further contains a benzidine compound having a group represented by the following formula (5), and wherein an amount of the benzidine compound having a group represented by the following formula (5) in the surface layer coating solution is 6% by mass or more and 20% by mass or less with respect to an entire amount of solid content in the surface layer coating solution, (5)

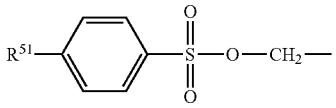

where, in the formula (5), $R^{51}$ represents a straight-chain alkyl group with a carbon number of 20 or less.

* * * * *